US007086867B2

(12) United States Patent
Nakagawa et al.

(10) Patent No.: US 7,086,867 B2
(45) Date of Patent: Aug. 8, 2006

(54) COAXIAL CONNECTOR

(75) Inventors: Tsuyoshi Nakagawa, Tokyo (JP); Tetsuya Ozaki, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/116,356

(22) Filed: Apr. 28, 2005

(65) Prior Publication Data

US 2005/0245104 A1 Nov. 3, 2005

(30) Foreign Application Priority Data

Apr. 28, 2004 (JP) ..... 2004-133554
Dec. 27, 2004 (JP) ..... 2004-377066

(51) Int. Cl.
*H01R 12/00* (2006.01)

(52) U.S. Cl. ..... 439/63; 439/944

(58) Field of Classification Search ..... 439/63, 439/188, 944; 200/51.09, 51.11, 51.1
See application file for complete search history.

(56) References Cited

U.S. PATENT DOCUMENTS 4,666,231 A * 5/1987 Sheesley et al. ..... 439/581
5,645,454 A * 7/1997 Kosmala ..... 439/675
5,839,910 A * 11/1998 Meller et al. ..... 439/188
6,053,743 A * 4/2000 Mitchell et al. ..... 439/63
6,824,392 B1 * 11/2004 Guo ..... 439/63
2005/0245104 A1 * 11/2005 Nakagawa et al. ..... 439/63

FOREIGN PATENT DOCUMENTS

JP 11-154569 6/1999
JP 2000-100530 4/2000

* cited by examiner

*Primary Examiner*—Tho D. Ta
*Assistant Examiner*—James R. Harvey
(74) *Attorney, Agent, or Firm*—Takeuchi&Kubotera, LLP

(57) ABSTRACT

The outer conductor is comprised of a first outer conductor (3) and a second outer conductor (4). The first outer conductor (3) and the second outer conductor (4) are connected to each other by attaching them to an insulating housing (1) and contacting the contact section (48) of the second outer conductor (4) to the first outer conductor (1). The backsides of the switching terminal (20) and the connecting terminal (21) are covered by a backside shielding section (43), and the lead section provided on the backside shielding section (43) is arranged between the lead section (20B) of the switching terminal (20) and the lead section (21B) of the connecting terminal (21).

19 Claims, 22 Drawing Sheets

E2-2

COAXIAL CONNECTOR

BACKGROUND OF THE INVENTION

The present invention relates to a coaxial connector having a switch, which is loaded in an information terminal device, such as a cellular phone, and used in input/output unit of such a device.

As shown in FIG. 33, a receptacle 80 of a conventional coaxial connector having a switch has an insulating housing 81, and a fitting convex section 82, which is formed at the insulating housing 81. A terminal attaching hole 83 is provided at the center portion of the fitting convex section 82. A connecting terminal 84 and a switching terminal having a contact section 85*a* are attached to the terminal attaching hole 83. A break contact point section 84*a* of the connecting terminal 84 contacts with the switching terminal 85. An outer conductor (shell) 86 is attached to the insulating housing 81, and a cylindrical section 87 of the outer conductor 86 covers the fitting convex section 82.

The receptacle 80 with the above-described constitution is mounted on a printed circuit board (not illustrated). The connecting terminal 84, the switching terminal 85, and the outer conductor 86 are to be soldered to conductive pattern (not illustrated) of the printed circuit board at respective lead sections 84*b*, 85*b*, and 86*b*.

A plug 90 to be connected to the receptacle 80 has an insulating housing 91, and an internal conductor 93 having a contact section 93*a* is provided at a center portion of the insulating housing 91. A cylindrical section 94*a* of an outer conductor 94 is provided at the insulating housing 91 so as to surround the internal conductor 93, and inner portion of the cylindrical section 94*a* forms a fitting concave section 92.

Once the plug 90 is inserted into the fitting concave section 92 of the plug 90 so as to insert the fitting convex section 82 of the receptacle 80 therein, the contact section 93*a* of the internal conductor 93 contacts with the contact section 85*a* of the switching terminal 85, and the inner conductor 93 of the plug 90 and the switching terminal 85 are connected to each other. At this time, the cylindrical section 94*a* of the outer conductor 94 of the plug 90 contacts with the cylindrical section 87 of the outer conductor 86, and is connected thereto. Then, by fitting and then connecting the cylindrical section 94*a* of the plug 90 to the cylindrical section 87 of the receptacle 80, the plug 90 is connected to the receptacle 80.

On the other hand, if the contact section 93*a* of the inner conductor 93 contacts with the contact section 85*a* of the switching terminal 85, the switching terminal 85 flexes, and the contact with the break contact point section 84*a* of the contact terminal 84 become lost.

If the plug 90 is pulled out, the switching terminal 85 moves back to the original position by its elasticity, and elastically contacts with the break contact point section 84*a* again. Therefore, according to this coaxial connector, the connection of the switching terminal 85 is switched from the connection with the connecting terminal 84 to the connection with the plug 90 by inserting the plug 90, and then switched back to the one with the connecting terminal 84 by removing the plug 90 (See Patent Reference 1).

As a conventional coaxial connector, there is one as illustrated in FIGS. 34 and 35. In the receptacle 104 of this coaxial connector, the outer conductor 100 has an outer conductor main body 100A which has a cylindrical section 100*a* that covers around the inner conductor 101. A backside shielding section 100*b* to cover a lead section 101*a* of the inner conductor 101 is connected to an inverted U-shaped rear portion of the outer conductor main body 100 A via a bent portion 100*c*.

By fitting and contacting the cylindrical section of the outer conductor of the plug (not illustrated) to the cylindrical section 100*a* of the outer conductor 100 of the receptacle 104, the outer conductor 100 of the receptacle 104 is connected to the outer conductor of the plug (See Patent Reference 2).

Patent Reference 1: Japan Unexamined Patent Application Publication H11-154569

Patent Reference 2: Japan Unexamined Patent Application Publication H2000-100530

In the first conventional coaxial connector as described above, as for the receptacle 80, the outer conductor 86 is attached to the insulating housing 81, and covers around the switching terminal 85 and the connecting terminal 84, which constitute the internal conductor, and the cylindrical section 87 of the outer conductor 86 covers the fitting convex section 82. Since there is no outer conductor at the lead sections 84*a* and 85*a* of the connecting terminal 84 and the switching terminal 85, there is a problem of unsatisfactory high-frequency performance due to lack of shielding.

In addition, in the latter above-described conventional coaxial connector, by fitting and connecting the cylindrical section of the outer conductor of the plug to the cylindrical section 100*a* of the outer conductor 100 of the receptacle 104, the outer conductor 100 of the receptacle 104 is connected to the outer conductor of the plug. However, the thickness of the cylindrical section of the plug is small and the cylindrical section is not strong enough and has weak locking ability, so that there is a problem that the plug comes off when the plug often receives external force.

In addition, the backside shielding section 100*b* of the outer conductor 100 is connected to the rear portion of the outer conductor main body 100A via the bent section 100*c*. The backside shielding section 100*b* is not bent at the bent section 100*c* before the outer conductor 100 is attached to the insulating housing 102, but it is bent after the outer conductor 100 is attached to the insulating housing 102. Therefore, it has been troublesome to assemble the receptacle 104.

SUMMARY OF THE INVENTION

Accordingly, it is a first object of the invention to provide a coaxial connector, which can be assembled easily, enables complete shielding of the inner conductor, and can achieve satisfactory high-frequency performance.

It is a second object to provide a coaxial connector, which can achieve satisfactory high-frequency performance even without the backside shielding.

In order to achieve the first object, there is provided a coaxial connector which comprises an insulating housing, an inner conductor connected to the counter inner conductor of the counter connector, and an outer conductor connected to the counter outer conductor of the counter connector. The outer conductor is comprised of a first outer conductor and a second outer conductor. The second outer conductor has a backside shielding section to cover the backside of the inner conductor and a locking section for joining to the counter connector. The first outer conductor and the second outer conductor have contacting means to contact to each other, and the first and the second outer conductors are connected to each other via the contact means.

With the above-described constitution, the outer conductor is comprised of the first and the second outer conductors, and the first and the second outer conductors are connected to each other via the contact means. In addition, since the backside of the inner conductor can be covered by the backside shielding section of the second outer conductor, the inner conductor can be completely shielded, and satisfactory high-frequency performance can be obtained. In addition, since joining to the counter connector can be made using the locking means of the outer conductor, the joining with the counter connector can be securely made, and even if the counter connector (e.g. plug) often receives external force, the counter connector (e.g. plug) will not come off.

In the coaxial connector of the invention, the insulating housing has a first outer conductor attaching section and a second outer conductor attaching section. By attaching the first outer conductor to the first outer conductor attaching section, and attaching the second outer conductor to the second outer conductor attaching section, the first and the second outer conductors are attached to the insulating housing.

With the above-described constitution, the first and the second outer conductors can be easily attached to the insulating housing.

In addition, the coaxial connector of this invention has a contact section on the backside shielding section, and the contact means is formed by contacting the contact section to the first outer conductor.

With such constitution, the first and the second outer conductors are attached to the insulating housing and connected to each other by contacting the contact section with the first outer conductor. Therefore, assembling of the connector is easier. In addition, since the backside of the inner conductor (e.g. first center terminal and the second center terminal, which works as a switching terminal) can be covered by the backside shielding section, the inner conductor can be completely shielded, and satisfactory high-frequency performance can be obtained.

The coaxial connector of the invention has a pair of contact sections on the backside shielding. Those contacts sections contact with both sides of the first outer conductor, and the first outer conductor is contacted with the backside shielding section via a conductive contact means.

With such constitution, as the path of ground current, in addition to the path from both sides of the first outer conductor to the second outer conductor via the contact sections, the path from the first outer conductor to the second outer conductor via the conductive contact means can be added. Therefore, the function of the outer conductor, which is comprised of the first and the second outer conductors, can be improved, and therefore, the high-frequency performance can be improved.

In the coaxial connector of the invention, the conductive contact means has a contact shoe at the edge of the first outer conductor, which faces the second outer conductor. The backside shielding section has a contact shoe joining hole. The contact shoe is inserted and joined to the contact shoe joining hole, and contacted with the inner surface of the contact shoe joining hole.

With the above-described constitution, as the path of ground current, in addition to the path from the side of the first outer conductor to the second outer conductor via the contact section, the path from the first outer conductor to the second outer conductor via the contact shoe can be added. For this reason, the function as the outer conductor, which is comprised of the first and the second outer conductors, can be improved, and the high-frequency performance can be improved.

In the coaxial connector of the invention, the contact shoe joining hole has a slit-like shape, and the contact shoe has at the base portion a pair of conductive contact sections, which are elastically deformable. While the contact shoe is inserted to the contact shoe joining hole, the conductive contact sections elastically contact with the inner surface of the contact shoe joining hole.

With such constitution, while the contact shoe is inserted in the contact shoe joining hole, the conductive contact sections are elastically contacted with the inner surface of the contact shoe joining hole. Therefore, the contact between the first and the second outer conductors can be securely made, the function of the outer conductor can be improved, and therefore, the high-frequency performance can be improved.

In the coaxial connector of this invention, the contact shoe joining hole has a slit-like shape, and the contact shoe has a strip-like shape. The contact shoe is inserted in the contact shoe joining hole, both edges of the contact shoe is contacted with the inner surface of the contact shoe joining hole, and the end portion protruded from the contact shoe joining hole of the contact shoe is contacted with the outer surface of the backside shielding section by bending it, and the edge of the first outer conductor, which face the second outer conductor, is contacted with the inner surface of the backside shielding section.

With such constitution, as the path of ground current, in addition to the path from the side of the first outer conductor to the second outer conductor via the contact section, the path from the first outer conductor to the second outer conductor via the contact shoe can be added. Therefore, the function of the outer conductor, which is comprised of the first and the second outer conductors, can be improved, and the high-frequency performance can be improved.

In the coaxial connector of this invention, the inner conductor is comprised of a first center terminal, and a second center terminal, which works as a switching terminal that moves away from the first center terminal by contacting with the contact section of the counter inner conductor. The backside shielding section has a backside circuit board connecting section for ground connection to the printed circuit board. This backside circuit board connecting section is arranged between the circuit board connecting sections of the first and the second center terminals.

With such constitution, the backside of the inner conductor (e.g. the first center terminal, and the second terminal which works as the switching terminal) can be covered by the backside shielding section. In addition, by arranging the backside circuit board connecting section between the circuit board connecting sections of the inner conductor, the inner conductor can be completely shielded, and satisfactory high-frequency performance can be obtained. In addition, at the time of joining with the counter connector, the connection of the second center terminal with the first center terminal switches to the one with the inner conductor of the counter connector. At the time of release of the joining, the connection is switched back to the one with the first center terminal. Therefore, the coaxial connector of this invention has a switch inside, and this coaxial connector can be loaded in information terminal devices or cellular phones, and can be used as the input/output unit of such devices.

In the coaxial connector of this invention, the first outer conductor has a cylindrical section, and an inverted U-shaped section, which is extended from the cylindrical section. One circuit board connecting section is provided at the edge of the inverted U-shaped section so as to be close to the cylindrical section, and the other circuit board connecting section is provided at the edge so as to protrude opposite the cylindrical section. By connecting those circuit board connecting sections to conductive section of the printed circuit board, the first outer conductor is connected to ground.

With such constitution, since the circuit board connecting section provided so as to be close to the cylindrical section, the connection of the cylindrical section to ground can be securely made, and more satisfactory high-frequency performance can be obtained.

In the coaxial connector of this invention, the circuit board connecting sections of the first and the second center terminals protrude from the backside of the insulating housing. The edge of the first outer conductor contacts with the backside shielding section by protruding from the backside of the insulating housing. The circuit board connecting section of the inner conductor is covered by the edges of the first outer conductor and the backside shielding section.

With such constitution, the circuit board connecting section of the inner conductor is covered by the edges of the first outer conductor and the backside shielding section. Therefore, the inner conductor is securely completely shielded, and more satisfactory high-frequency performance can be obtained.

In the coaxial connector of this invention, a protrusion is provided on the backside of the insulating housing. By contacting the protrusion with the backside shielding section at the time of attaching the second outer conductor to the insulating housing, the second outer conductor is positioned, and the circuit board connecting section of the first center terminal is placed on one side of the protrusion, and the circuit board connecting section of the second center terminal is placed on the other side of the protrusion.

With the above-described constitution, at the time of attaching the second outer conductor to the insulating housing, by contacting the backside shielding section to the protrusion, the second outer conductor is positioned. In addition, since the circuit board connecting section of the first center terminal is placed at one side of the protrusion, and the circuit board connecting section of the second center terminal is placed at the other side of the protrusion, the distance between the outer conductor and the inner conductor is maintained constant and short, so that more satisfactory high-frequency performance can be obtained.

In order to achieve the second object, the coaxial connector of this invention is composed by attaching to an insulating housing an inner conductor, which is connected to the counter inner conductor of the counter connector, and an outer conductor, which is connected to the counter outer conductor of the counter connector. The outer conductor is comprised of a first outer conductor and a second outer conductor. The first outer conductor has a cylindrical section and an inverted U-shaped section, which is extended from the cylindrical section. A circuit board connecting section is provided at the edge of the inverted U-shaped section near the cylindrical section, and the second outer conductor has a circuit board connecting section. Those circuit board connecting sections are connected to conductive sections of the printed circuit board, and the first and the second outer conductors are connected to ground.

With such constitution, even without backside shielding, connection to ground can be securely made by circuit board connecting section provided so as to close to the cylindrical section, and satisfactory high-frequency performance can be obtained.

According to the coaxial connector of this invention, the outer conductor is comprised of the first and the second outer conductors, and the first and the second outer conductors are connected to each other by contact means. Since the backside of the inner conductor can be covered by the backside shielding section provided on the second outer conductor, the inner conductor can be completely shielded, and satisfactory high-frequency performance can be obtained. In addition, since the joining with the counter connector can be made by he locking section of the outer conductor, the joining (locking) can be securely made, and the counter connector (e.g. plug) will not come off even if the counter connector (e.g. plug) often receives external force.

According to the coaxial connector of this invention, the backside of the inner conductor (e.g. the first center terminal, and the second center terminal which works as a switching terminal) can be covered by the backside shielding section. In addition, by arranging the backside circuit board connecting section between the circuit board connecting sections of the inner conductor, the inner conductor can be completely shielded, and satisfactory high-frequency performance can be obtained. In addition, at the time of joining with the counter connector, the connection of the second center terminal with the first center terminal is switched to the one with counter inner conductor, and at the time of release of the joining, the connection is back to the one with the first center terminal. Therefore, the coaxial connector has a switch inside, and it can be loaded in information terminal devices or cellular phone, and can be used as the input/output unit of such devices.

In addition, according to the coaxial connector of the invention, even when the backside shielding is not applied, connection to ground can be securely made by a circuit board connecting section, which is provided so as to be close to the cylindrical section, and satisfactory high-frequency performance can be obtained.

DESCRIPTION OF THE PREFERRED EMBODIMENTS

Embodiments of the invention will now be fully described with reference to the accompanying drawings.

First Embodiment:

The first embodiment of the coaxial connector of the invention is shown in FIGS. 1–15.

Figure 1:
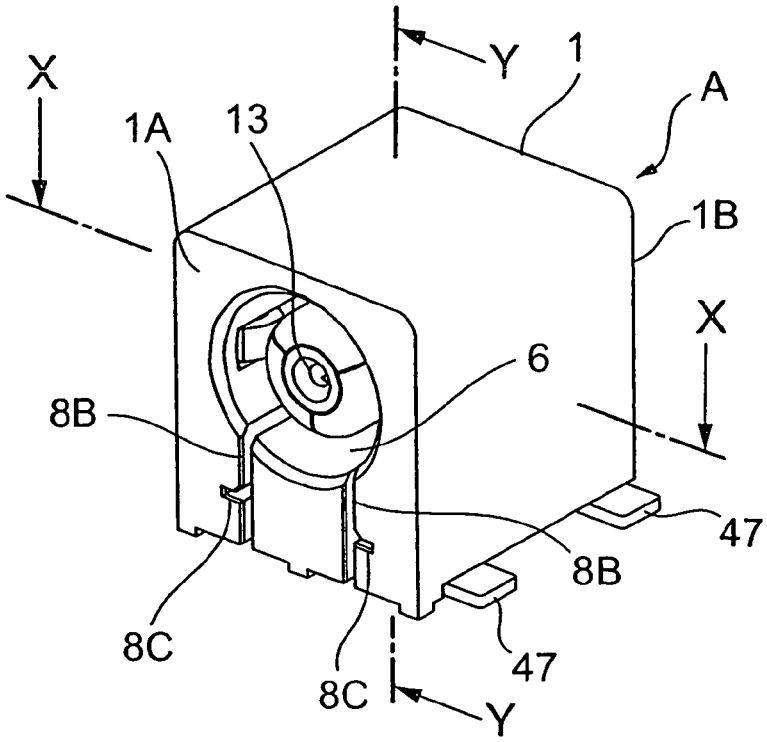
FIG. 1 is a perspective front view of the receptacle (first embodiment), which is the coaxial connector of the invention.
Figure 2:
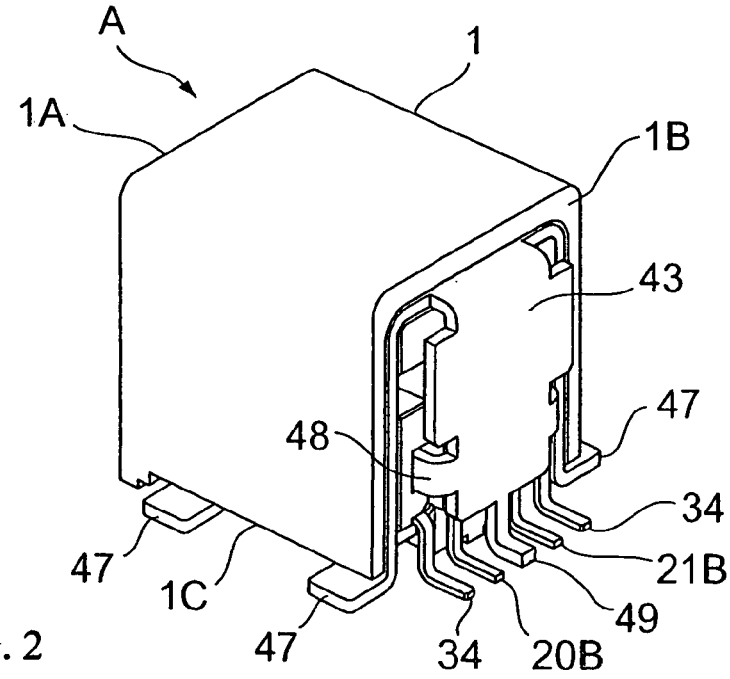
FIG. 2 is a perspective backside view of the receptacle of FIG. 1.
Figure 3:
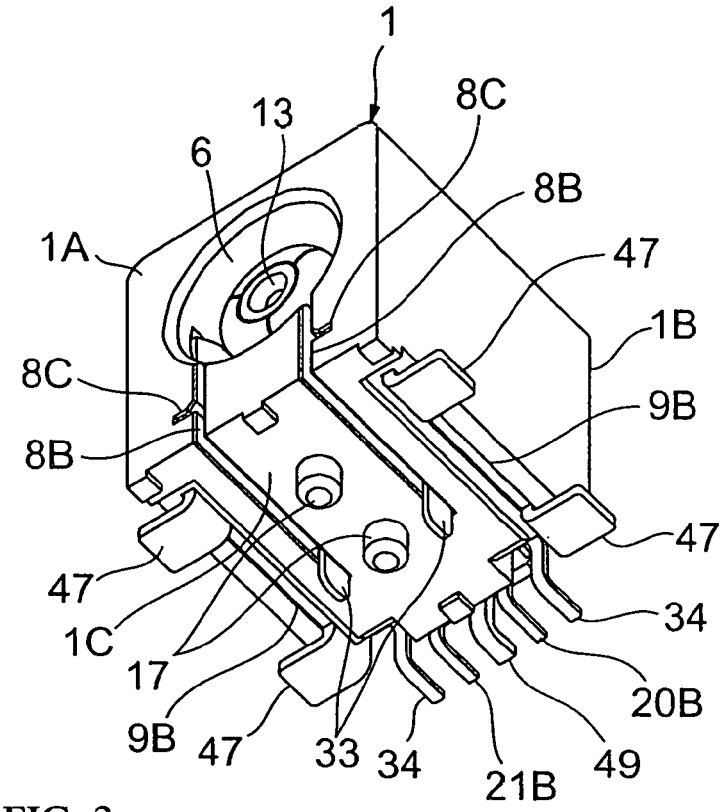
FIG. 3 is a perspective bottom view of the receptacle of FIG. 1.
Figure 4:
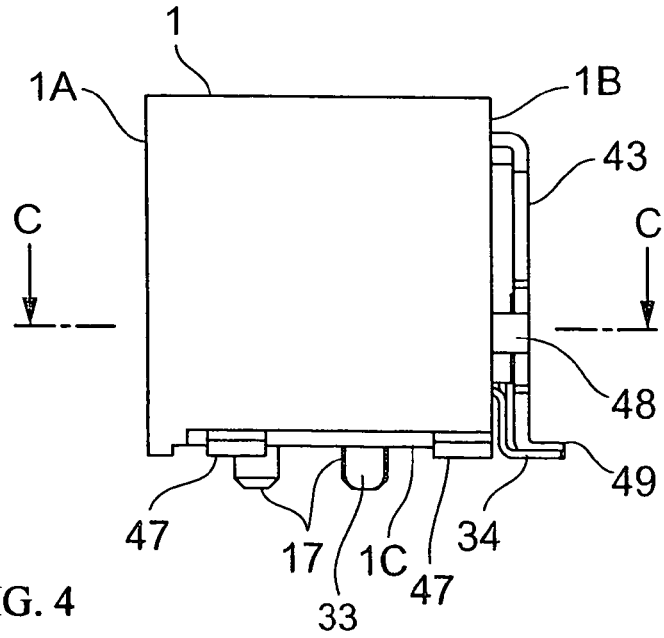
FIG. 4 is a side view of the receptacle of FIG. 1.
Figure 5:
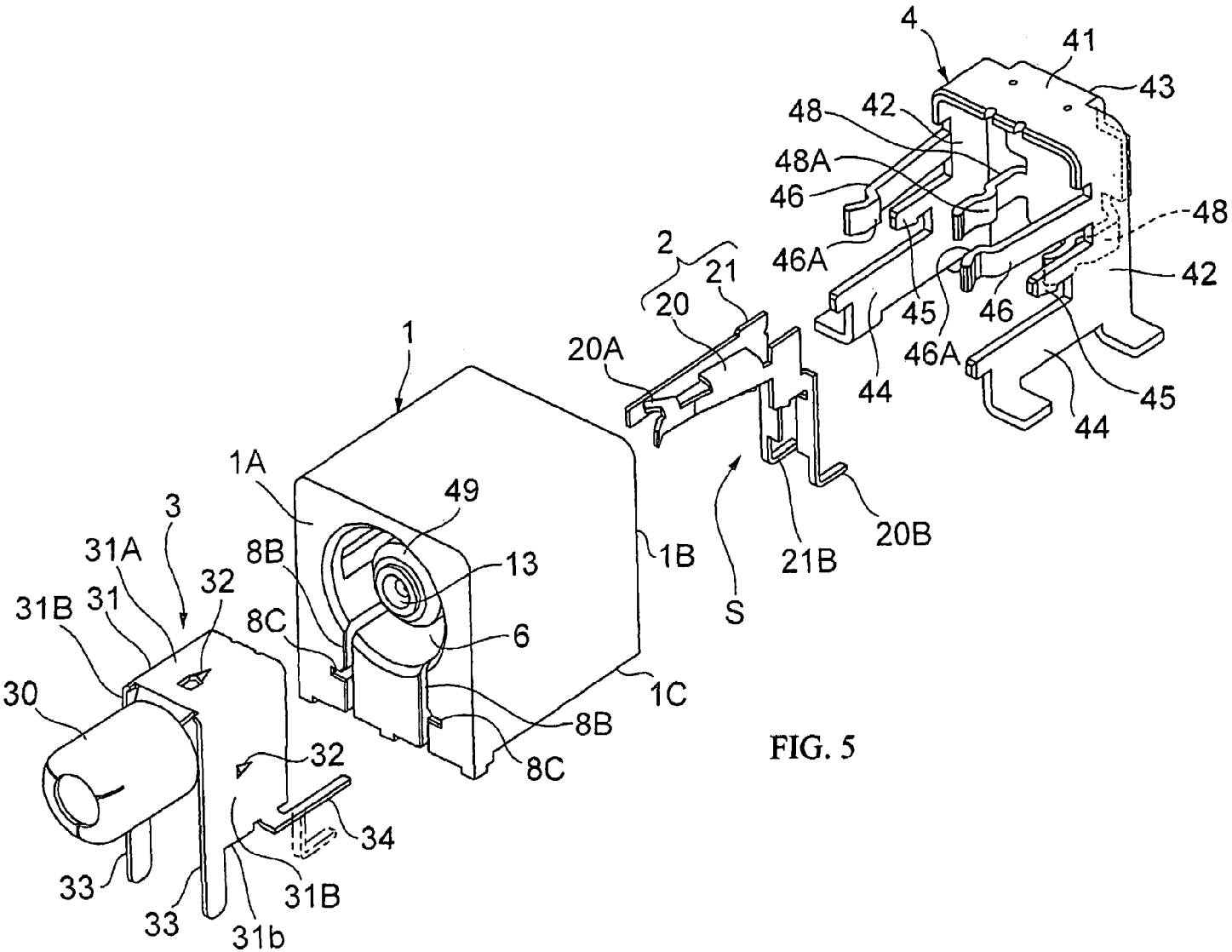
FIG. 5 is an exploded perspective front view of the receptacle of FIG. 1.

The receptacle A, which is the coaxial connector of the invention, is to join to a plug B, which is the counter connector. As shown in FIG. 5, the receptacle A is comprised of an insulating housing 1, an inner conductor 2, and a first and a second outer conductors, which constitutes an outer conductor.

Figure 7:
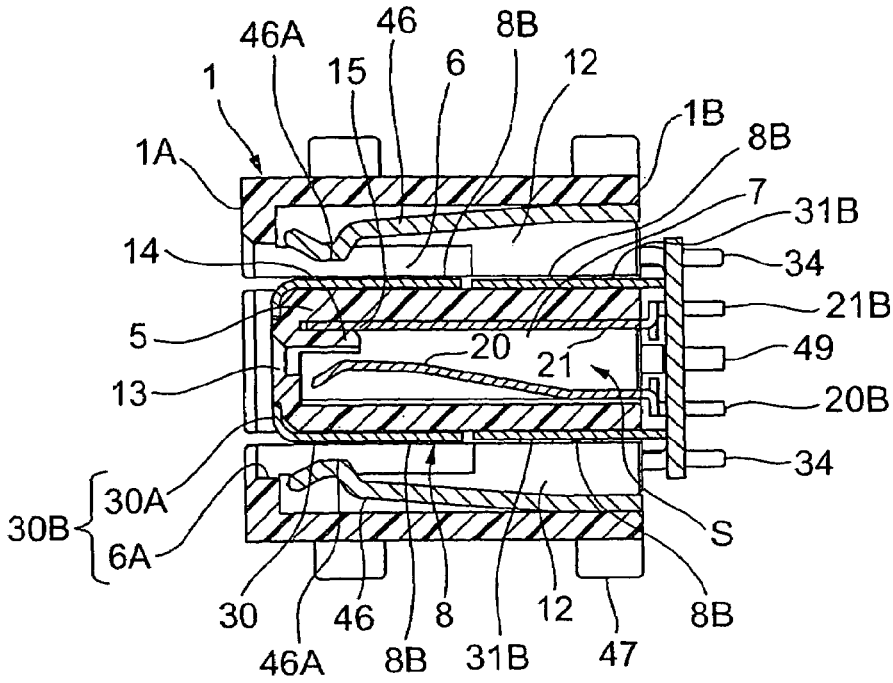
FIG. 7 is a cross-sectional view taken along line X—X in FIG. 1.
Figure 8:
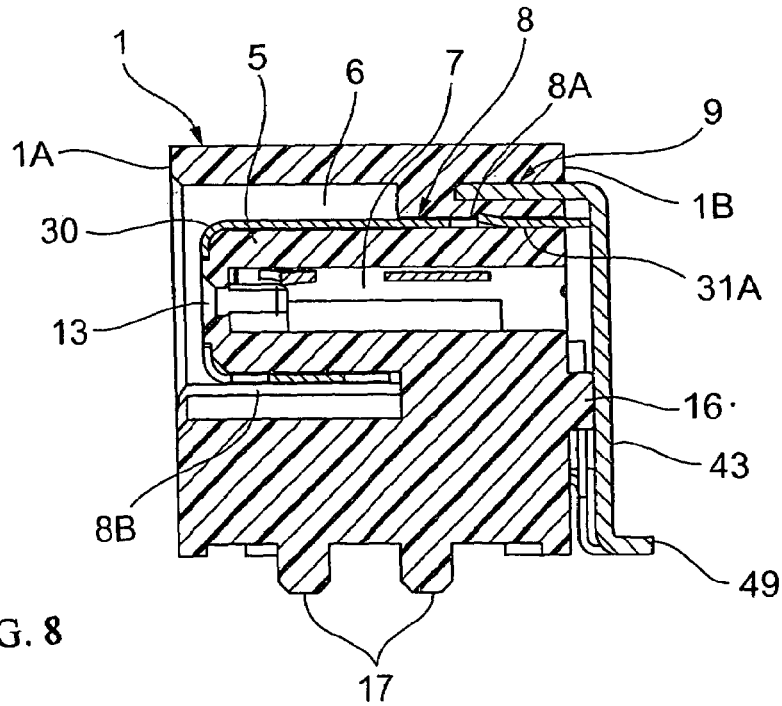
FIG. 8 is a cross-sectional view taken along line Y—Y in FIG. 1.

As shown in FIGS. 7 and 8, the insulating housing 1 has an inner housing section 5, and a counter connector fitting concave section 6 provided to surround the inner housing 5. An inner conductor attaching section 7 is formed at the center portion of the inner housing section 5. In addition, a first and a second outer conductor attaching sections 8 and 9 are formed so as to surround the inner conductor attaching section 7.

As shown in FIGS. 3, 5, and 7–9, the first outer conductor attaching section 8 is formed from the front section 1A toward the backside section 1B of the insulating housing 1, and comprised of an edge shielding insertion groove 8A, side shielding insertion groove 8B, and a lead insertion section 8C. The side shielding insertion grooves 8B are provided being extended from each side of the edge shielding insertion groove 8A, and the side shielding insertion groove 8B goes through the circuit board side surface 1C of the insulating housing 1 (See FIG. 3).

Figure 9:
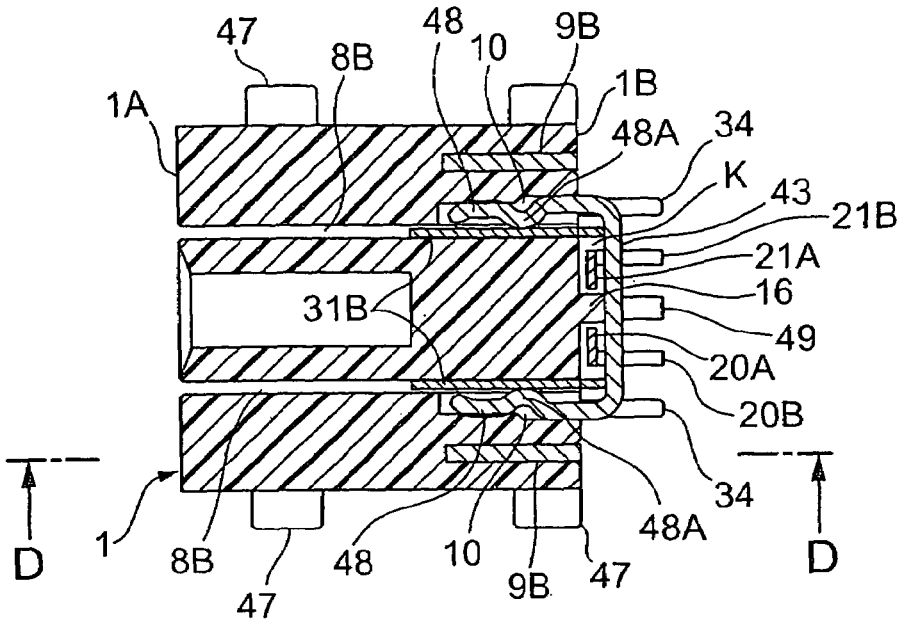
FIG. 9 is a cross-sectional view taken along C—C in FIG. 4.

As shown in FIGS. 6–10, the second outer conductor attaching section 9 is formed from the backside section 1B toward the front side section 1A, and is comprised of an edge shielding insertion groove 9A, a side shielding insertion groove 8B, and a pair of insertion grooves 10. The side shielding insertion grooves 9B are arranged being extended from each side of the edge shielding insertion groove 9A. The edge shielding insertion groove 9A and the side shielding insertion grooves 9B go through the circuit board side surface 1C. As shown in FIG. 9, a pair of insertion grooves 10 extends to the side shielding insertion grooves 8B of the first outer conductor attaching section 8.

Figure 10:
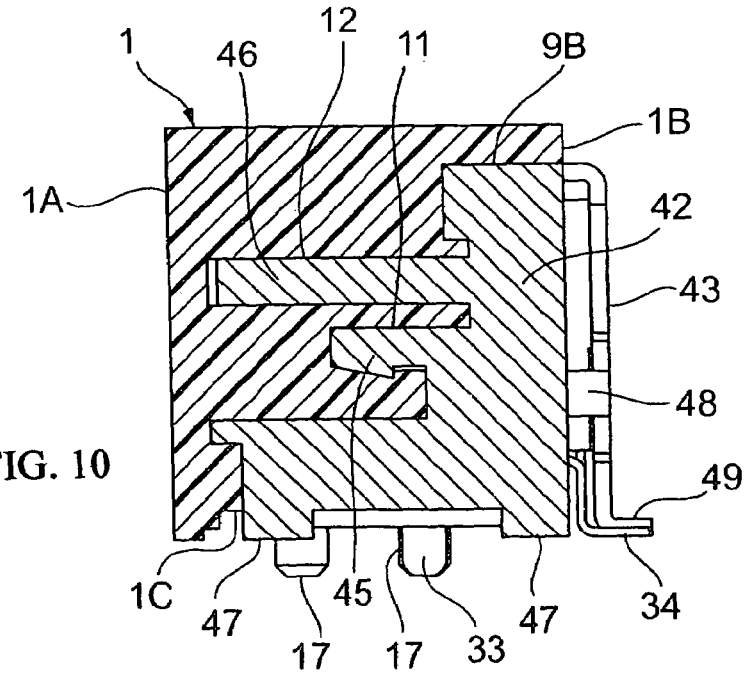
FIG. 10 is a cross-sectional view taken along line D—D in FIG. 9.

As shown in FIG. 10, the insulating housing 1 has a press-in groove and a locking section insertion groove 12, which are extended from the side surface shielding insertion groove 9B. As shown in FIG. 7, the locking section insertion groove 12 is opened to the counter connector fitting concave section 6.

As shown in FIGS. 7 and 8, the insulating housing 1 has the above-described inner conductor attaching section 7 from the backside section 1B toward the front side section 1A. The inner conductor attaching section 7 is provided inside the inner housing section 5, and a counter contact insertion slot 13, which is connected to the inner conductor attaching section 7, is provided at the end of the inner housing section 5. At the end portion of the inner conductor attaching section 7, a dividing wall section 14, whereby the insertion groove 15 is divided from the counter contact insertion slot 13, is provided. As shown in FIG. 8, the insulating housing 1 has a protrusion 16 on the backside section 1B, and has locking protrusions 17 on the circuit board side section 1C.

Figure 6:
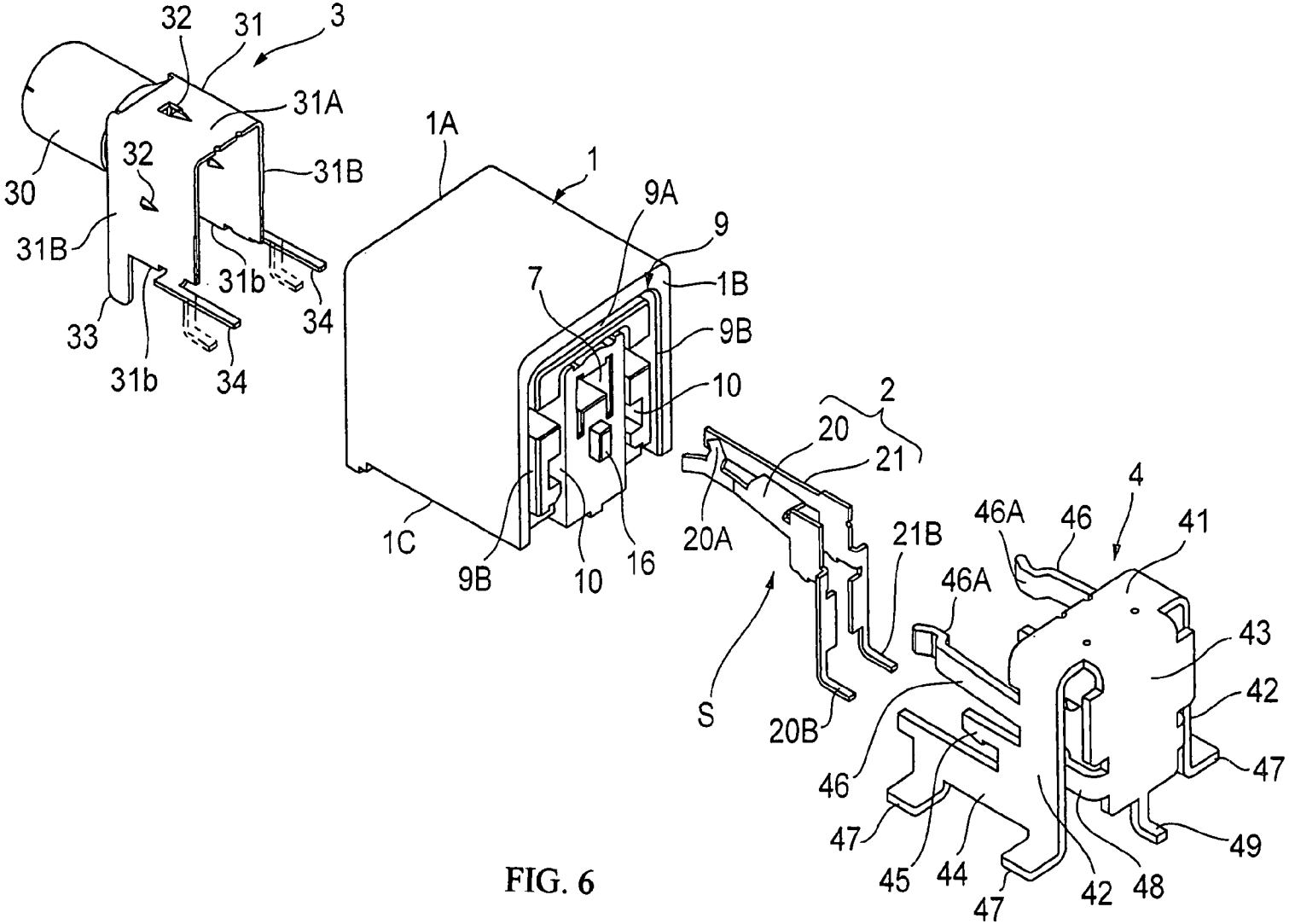
FIG. 6 is an exploded perspective backside view of the receptacle of FIG. 1.

As shown in FIGS. 5–6, the inner conductor 2 is comprised of a switching terminal (second center terminal) 20 having a contact point section 20A, and a connecting terminal (first center terminal) which contacts with the contact point section 20A. The switching terminal 20 has a spring characteristics which enables elastic flexing deformation. In addition, the switching terminal 20 and the connecting terminal 21 have lead sections 20B and 21B respectively, which are circuit board connecting sections.

As shown in FIGS. 5–6, the first outer conductor 3 is comprised of a circular cylindrical section 30 and an inverted U-shaped section 31 that is extended to the cylindrical section 30. This inverted U-shaped section 31 has an edge shielding section 31A, and side shielding sections (sides of the first outer conductor 3) arranged at both sides of the edge shielding section 31A. The edge shielding section 31A and the side shielding sections 31B respectively have a lance section 32, which is a cut-out section.

A lead section 33, which is another circuit board connecting section, is formed at the edges 31*b* of the both side shielding sections 31B near the cylindrical section 30 side, which is near the position of contacting with the counter outer conductor. A lead section 34, which is another circuit board connecting section, is formed at the edges 31*b* of the both side shielding sections 31B so as to protrude opposite the cylindrical section 30 side.

As shown in FIGS. 5–6, the second outer conductor 4 has an edge shielding section 41, side shielding sections 42, which extend to the each edge of the edge shielding section 41, and a backside shielding section 43 which extends to rear edge section of the edge shielding section 41. A securing section 44, a press-in section 45, and a locking section 46 are provided at the front edge section of the both side shielding sections 42 so as to protrude forward. A joining section 46A is formed at the end of each locking section 46, and a pair of lead sections, which are circuit board connecting sections, is provided at the front and the rear portions of the securing sections 44.

A pair of strip-shaped contact sections 48 is provided at both side edges of the backside shielding section 43 so as to protrude forward. A contact point sections 48A are formed at the ends of the contact sections 48. In addition, a lead section 49, which is a backside circuit board connecting section, is provided at the lower edge of the backside shielding section 43.

As shown in FIGS. 7 and 8, the switching terminal 20 and the connecting terminal 21 are attached to the inner conductor attaching section 7 of the insulating housing 1 by pressing therein from the backside. The end of the connecting terminal 21 is inserted into the insertion groove 15 which is divided by the dividing wall section 14. The contact point section 20A of the switching terminal 20 contacts with the connecting terminal 21. The switching terminal 20 and the connecting terminal 21 constitute a switch S. The lead sections 20B and 21B, which are circuit board connecting sections of the switching terminal 20 and the connecting terminal 21 respectively, protrude outward from the backside section 1B of the housing 1.

The first outer conductor 3 is attached to the first outer conductor attaching section 8 by pressing from the front side. The cylindrical section 30 of the first outer conductor 3 covers the inner housing 5. As shown in FIG. 7, the end section 30A is curved inward so as to fit to the end section of the first outer conductor attaching section 8. The end section 30A of the cylindrical section 30 and the inner circumferential surface 6A of the end section of the counter connector fitting concave section 6 forms the counter connector guiding section 30B.

The edge shielding section 31A and the side shielding section 31B of the first outer conductor 3 are attached to the first outer conductor attaching section 8. In other words, the edge shielding section 31A and the side shielding section 31B are respectively inserted into the edge shielding insertion groove 8A and the side shielding insertion groove 8B. The lead section provided at the side shielding section 31B is inserted into the lead insertion section 8C. Those lead sections 34 are bent to have a crank-shape after protruding outside of the backside 1B of the insulating housing 1. The lance section 32 is locked at walls of the edge shielding groove 8A and the side shielding insertion groove 8B.

The second outer conductor 4 is attached to the second shielding member attaching section 9 by pressing from the backside of the insulating housing. More specifically, the edge shielding section 41 of the second outer conductor 4 is inserted into the edge shielding insertion groove 9A, and the side shielding section 42 and the securing section 44 are inserted into the side surface shielding insertion groove 9B. As shown in FIG. 10, the press-in section 45 is pressed in the press-in groove 11, and the locking section 46 is inserted into the locking section insertion groove 12. The engaging section 46A at the end of the locking section 46 protrudes into the counter connector fitting concave section 6. With the above constitution, the locking means is formed (See FIG. 7). The lead section 47 provided at the securing section 44 protrudes outside of the circuit board side section 1C of the housing 1.

As shown in FIG. 9, a pair of strip-like contact sections 48 protruded on the backside shielding section 43 is inserted into a pair of insertion grooves 10 of the second shielding member attaching section 9. The contact point section 48A of each contact section 48 contacts with the side shielding section 31B of the first outer conductor 3.

In this case, as shown in FIG. 9, the inner surface of the backside shielding section 43 contacts with the protrusion 16, and space K is formed between the backside shielding section 43 and the backside section 1B of the insulating housing 1. The edge sections of the edge shielding section 31A the side shielding section 31B of the first outer conductor 3 protrude to the space K, and are close to or contact with the inner surface of the backside shielding section 43. In addition, lead sections 20B and 21B of the switching terminal 20 and the connecting terminal 21 are arranged in the space K.

A contact means is formed by contacting a pair of the contact sections 48 of the backside shielding section 43 with the side shielding section 31B of the first outer conductor 3, and contacting the respective edges (edges of the first outer conductor, which face the second outer conductor) of the edge shielding section 31A and the side shielding section 31B of the first outer conductor 3 with the inner surface of the backside shielding section 43.

In the receptacle A constituted as described above, the first outer conductor 3 and the second outer conductor 4 are connected to each other by the above contact means. The first outer conductor surrounds the front and around the switching terminal 20 and the connecting terminal 21, which are inner conductor 2, and the backside of the switching terminal 20 and the connecting terminal 21 are covered by the backside shielding section 43. With this constitution, the inner conductor is completely shielded.

Figure 11:
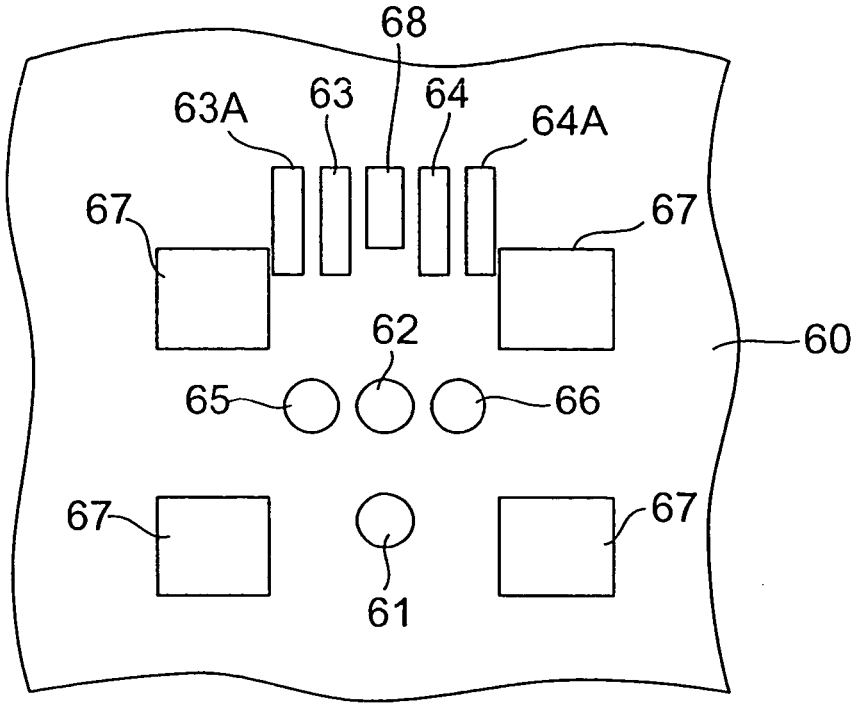
FIG. 11 is an explanatory figure of the printed circuit board to mount the receptacle (first embodiment), which is the coaxial connector of the invention.

The receptacle A with the above constitution is mounted on a printed circuit board 60 illustrated in FIG. 11. More specifically, the receptacle A is mounted on the printed circuit board 60 as follows. The latching protrusions 17 provided on the circuit board side section 1C is inserted and latched in the latching holes 61 and 62 of the printed circuit board 60. Respective lead sections 20B and 21B of the switching terminal 20 and the connecting terminal 21 are soldered to the conductive patterns (conductive sections) 63 and 64. The lead sections 33 of the first outer conductor 3 are inserted and soldered in the thru holes (conductive sections) 65 and 66. The lead section 47 of the second outer conductor 4 is soldered to the conductive pattern (conductive section) 68 so as to connect to ground. Furthermore, the lead section 49 of the backside shielding section 43 of the second outer conductor is soldered to the conductive pattern (conductive section) 68 and connect to ground. At this time, the thru holes (conductive sections) 65 and 66 are located inside of the conductive pattern 67, which enables connection to ground despite of the small space.

Figure 12:
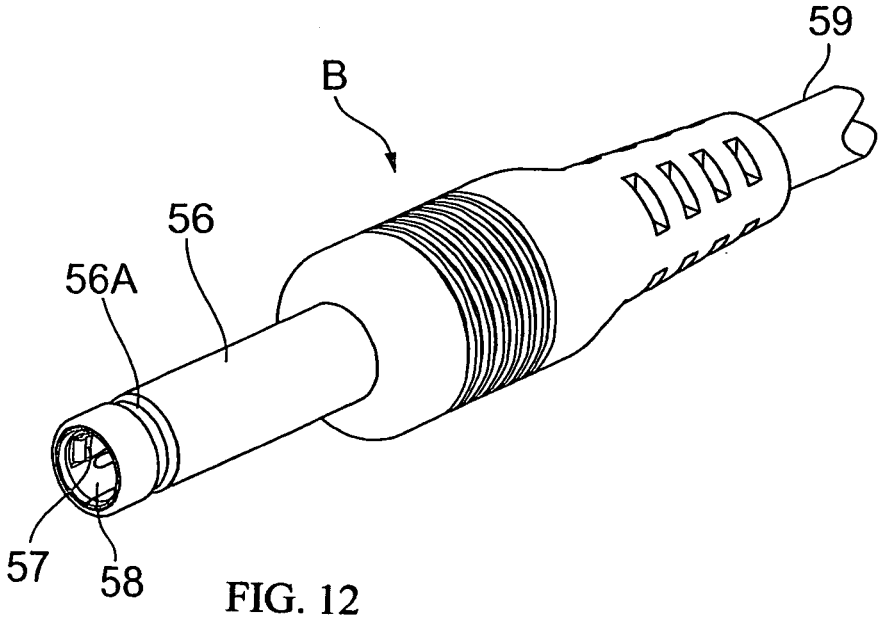
FIG. 12 is a perspective view of the plug.
Figure 13:
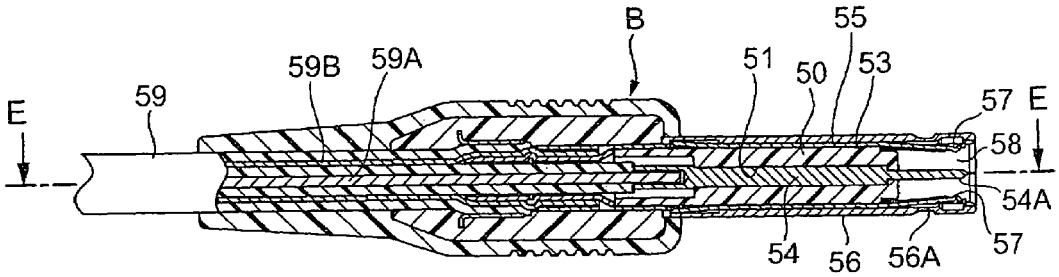
FIG. 13 is a longitudinal cross-sectional view of the plug.
Figure 14:
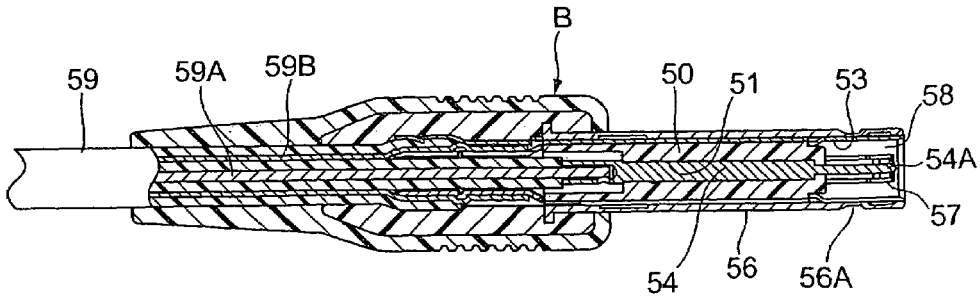
FIG. 14 is a cross-sectional view of FIG. 13 taken along line E—E in FIG. 13.

As shown in FIGS. 12–14, the plug B has an insulating housing 50, which has an inner conductor attaching section 51. The outer circumferential section of the insulating housing 50 constitutes an outer conductor fitting section 53. The inner conductor 54, which is the counter inner conductor, is attached to the inner conductive attaching section 51, while the outer conductor 55, which is the counter outer conductor, is attached to the outer conductor attaching section 53. At the outer circumferential portion of the outer conductor, a locking member 56 is attached.

The locking member 56 is a conductive cylindrical body, and has a joining concave section 56A, which comprises an annular groove, at the outer circumferential portion. The end of the locking member 56 has a fitting concave section 58, and the outer conductor 55 is provided along the inner surface of the fitting concave section 58. A pair of contact point members 57, which comprises spring bars, is provided at the end of the outer conductor 55.

The inner conductor 54 has a pin-like contact section 54A at its end. This contact section 54A is located at the center portion of the fitting concave section 58. The inner conductor 54 is connected to the inner conductor 59A of the coaxial cable 59, while the outer conductor 55 is connected to the outer conductor 59B of the coaxial cable 59. The joining between the receptacle A and the plug B, which are constituted as described above will be described below.

Figure 15:
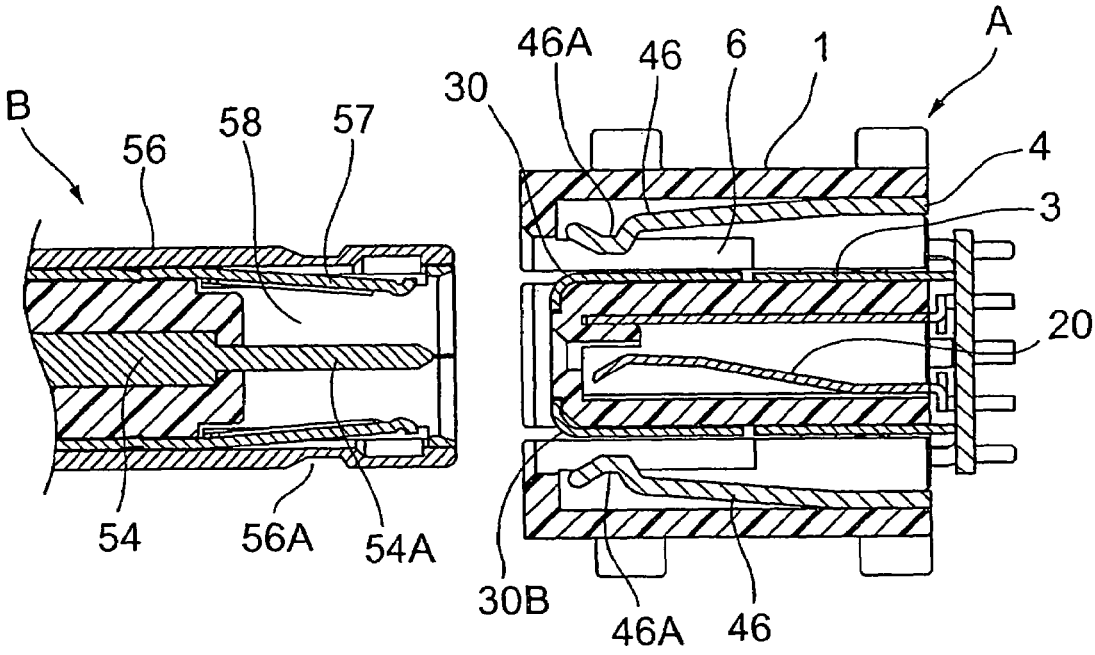
FIG. 15 is an explanatory cross-sectional view of the receptacle, which is the coaxial connector of the invention, and the plug before they are joined.

In FIG. 15, the locking member 56 of the plug B is inserted in the counter connecter fitting concave section 6 of the receptacle A being guided by the counter connector guiding section 30B. The joining section 46A of the locking section 46 of the second outer conductor 4 contacts with the outer circumferential portion of the locking member 56, and the contact point member 57 of the outer conductor 54 of the plug B contacts with the cylindrical section 30 of the first outer conductor 3 of the receptacle A.

By pressing the plug B further, the contact section 54A of the inner conductor 54 of the plug B contacts with the switching terminal 20, which is the inner conductor 2 of the receptacle A. Then, by pressing the switching terminal 20 with the contact section 54A, the switching terminal 20 flexes, and the contact point section 20A moves away from the connecting terminal 21. By doing this, a circuit formed by contacting the contact point section 20A of the switching terminal 20 with the connecting terminal 21 is switched to a circuit formed by contacting the inner conductor 54 of the plug B with the switching terminal 20.

Then, by pushing the plug B further, the joining section 46A of the locking section 46 of the second outer conductor 4 is latched in the joining concave section 56A of the locking member 56 of the plug B. By removing the plug B from the receptacle A, the contact of the contact section 54A of the inner conductor 54 of the plug B with the switching terminal 20 is released and the contact point section 20A of the switching terminal 20 contacts with the connecting terminal 21, so as to switch circuits.

According to the above-described first embodiment, the outer conductor is comprised of the first outer conductor 3 and the second outer conductor 4. The first outer conductor 3 and the second outer conductor 4 are attached to the insulating housing 1, and connected to each other by contacting the contact section 48 of the second outer conductor 4 with the first outer conductor 3. With such constitution, the assembling is made easy. In addition, since the backsides of the switching terminal 20 and the connecting terminal 21 are covered by the backside shielding section 43, and the lead section 49, which is the backside circuit board connecting section, is arranged between the lead section 20B of the switching terminal 20 and the lead section 21B of the connecting terminal 21, the switching terminal 20 and the connecting terminal 21 are completely shielded, and satisfactory high-frequency performance can be achieved. In addition, the connection with the plug B, which is the counter connector, can be made by joining the joining section 46A of the locking section 46 of the second outer conductor 4 to the joining concave section 56A of the locking member 56 of the plug B, the joining (locking) with the plug B can be securely made. In addition, even if the plug B receives external force often, the plug B will not come off.

According to the first embodiment, the cylindrical section 30 can be securely connected to ground by the lead sections 33, which are provided near the cylindrical section 30 and near the contact position with the counter outer conductor, and satisfactory high-frequency performance can be achieved.

According to the first embodiment of the invention, the lead sections 20B and 21B of the switching terminal 20 and the connecting terminal 21 protrude from the backside 1B of the insulating housing. The edge of the first outer conductor 3 contact with the backside shielding section 43 by protruding from the backside 1B of the insulating housing. The lead sections 20B and 21B of the switching terminal 20 and the connecting terminal 21 are covered by the edges of the first outer conductor 3 and the backside shielding section 43. Accordingly, the switching terminal 20 and the connecting terminal 21 can be securely completely shielded, and more satisfactory high-frequency performance can be obtained.

According to the first embodiment, the inner conductor 2 is comprised of a connecting terminal 21, and the switching terminal 20, which moves away from the connecting terminal 21 by contacting with the contact section 54A of the inner conductor 54 of the plug B. When the receptacle is joined to the plug B, the connection between the switching terminal 20 and the connecting terminal 21 is switched to the one between the switching terminal 20 and the contact section 54A. When the joining is released, the connection of the switching terminal with the contact section 54A turns back to the one with the connecting terminal 21. Since the receptacle of this embodiment has a switch that switches the connections as described above, the coaxial connector can have a switch S in its inside. Therefore, this coaxial connector can be loaded in information terminal device or cellular phone, and used as input/output unit of such devices.

According to the first embodiment, since the protrusion 16 is provided on the backside 1B of the insulating housing 1, at the time of attaching the second outer conductor 4 to the insulating housing, the second outer conductor 4 can be positioned by moving the backside shielding section 43 close to or contacting it with the protrusion 16. In addition, since the lead section 21B of the connecting terminal 21 is arranged at one side of the protrusion 16, and the lead section 20B of the switching terminal 20 is arranged at the other side of the protrusion 16, the distances from the second outer conductor 4 to the switching terminal and the connecting terminal 21 can be constant and kept short, more satisfactory high-frequency performance can be obtained.

In the first embodiment, a pair of flat bar-shaped contact sections 48 is provided at the side edges of the backside shielding section 43 so as to protrude forward, but the flat bar-shaped contact sections can protrude backward from the first outer conductor 3. The first outer conductor 3 and the second outer conductor 4 are respectively attached to the first outer conductor attaching section 8 and the second outer conductor attaching section 9, but the first and the second outer conductors can be integrally formed with the insulating housing 1.

Second Embodiment:

The second embodiment of the coaxial connector of the invention is shown in FIGS. 16–24. Here, similar elements to those in the first embodiment are denoted by the same referential numerals, and the explanation is omitted.

In the second embodiment of the invention, the contact means to contact the first outer conductor 3 with the second outer conductor 4 is formed by contacting the pair of contact sections 48 of the backside shielding section 43 of the second outer conductor 4 with the side shielding section 31B (side portion of the first outer conductor 3); and contacting the edge shielding section 31A of the first outer conductor 3 with the backside shielding section 43 via a conductive contact means F.

Figure 16:
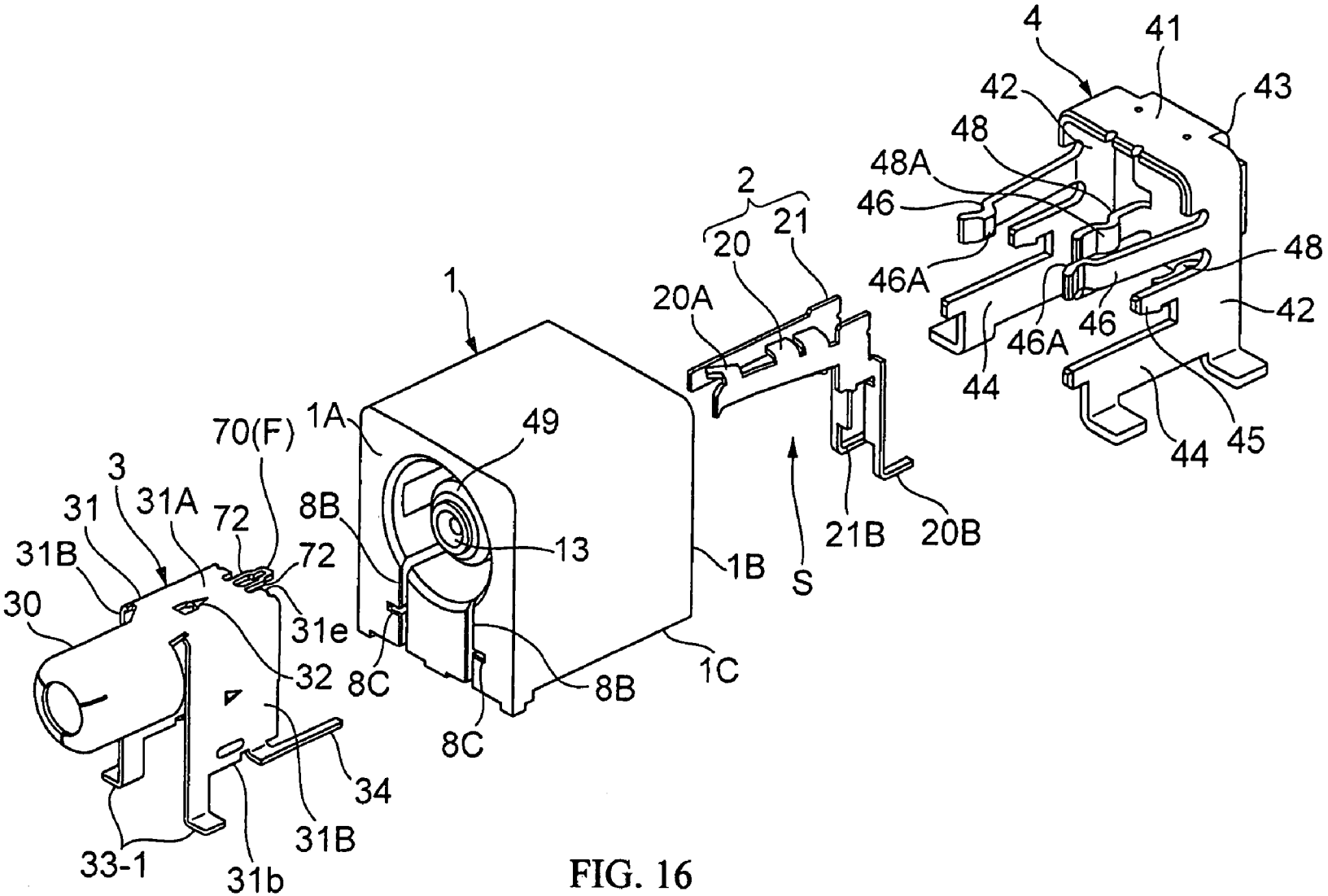
FIG. 16 is an exploded perspective front view of the receptacle (second embodiment), which is the coaxial connector of the invention.
Figure 17:
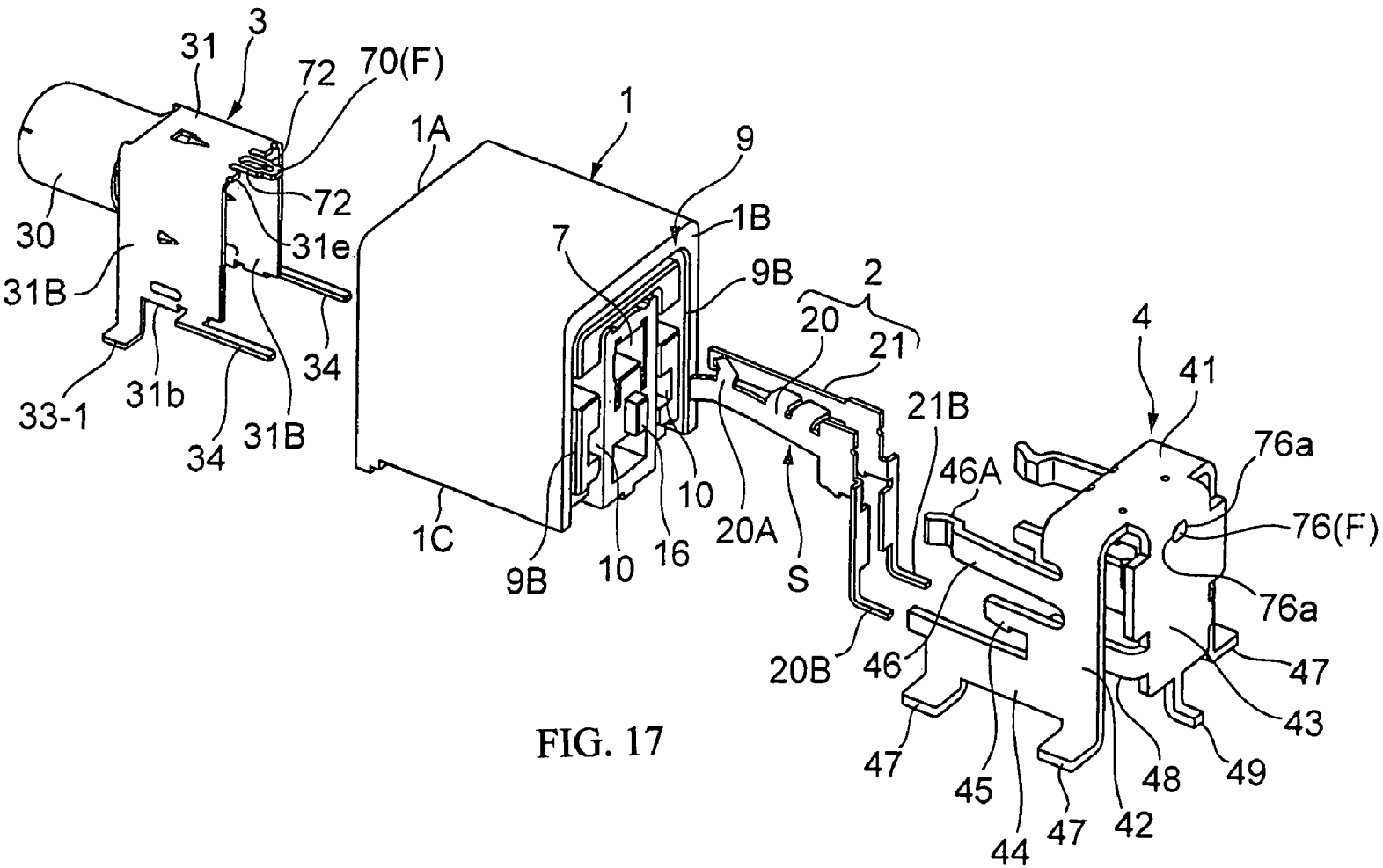
FIG. 17 is an exploded perspective backside view of the receptacle of FIG. 16.
Figure 18:
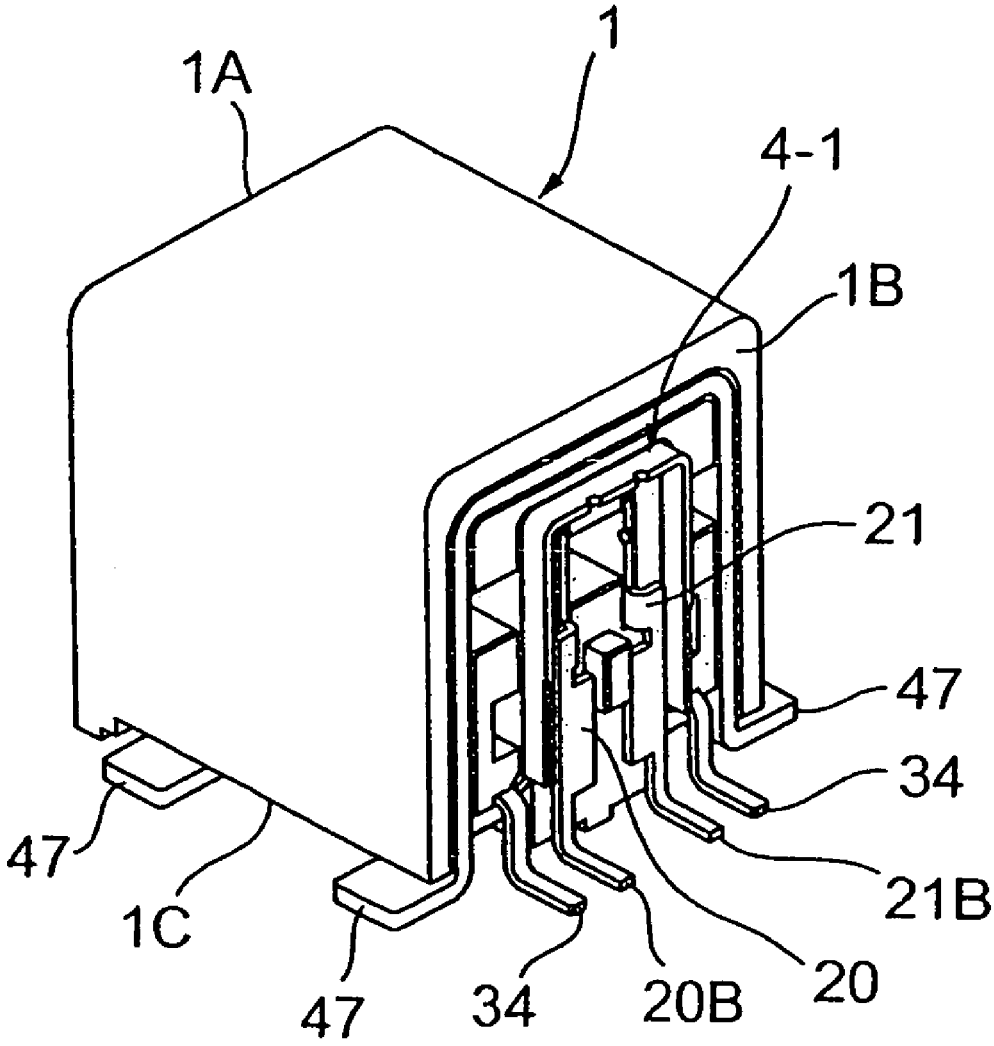
FIG. 18 is a perspective backside view of the receptacle of FIG. 16.
Figure 19:
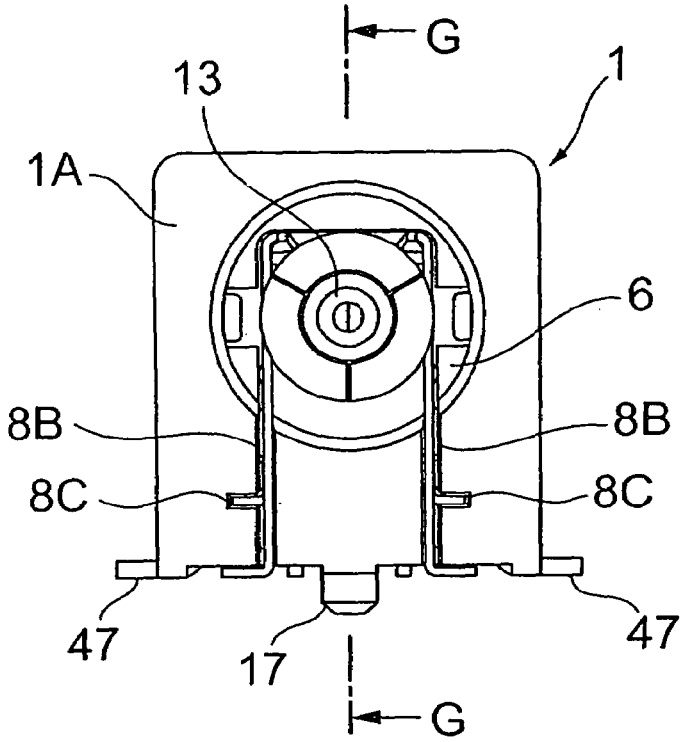
FIG. 19 is a front view of the receptacle of FIG. 16.
Figure 20:
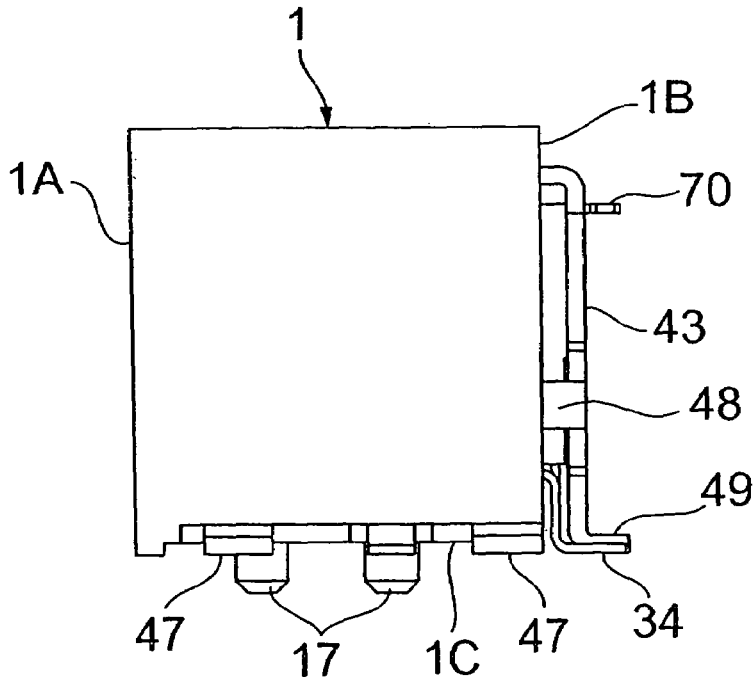
FIG. 20 is a side view of the receptacle of FIG. 16.
Figure 21:
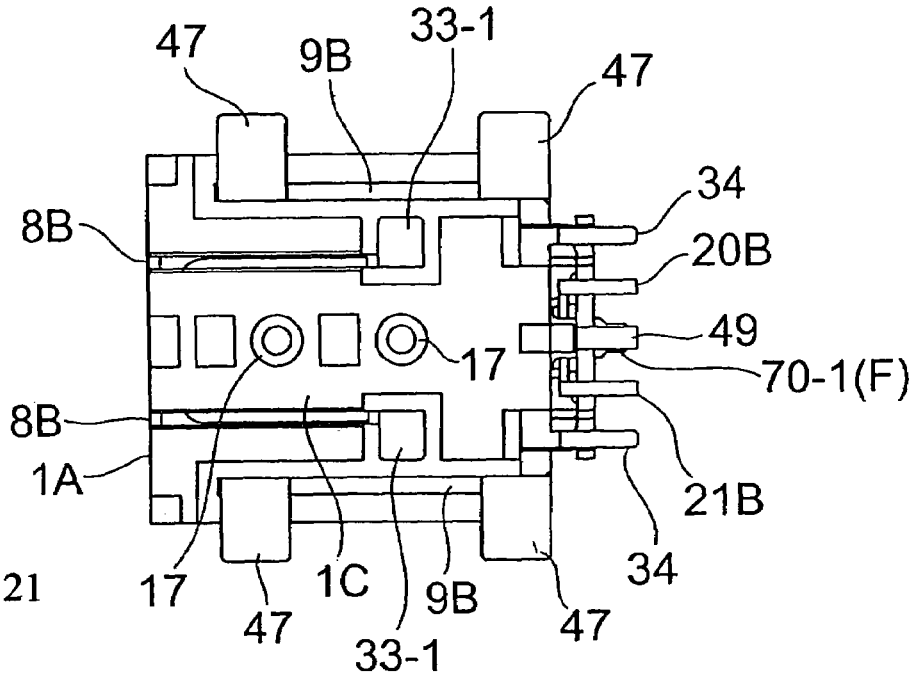
FIG. 21 is a bottom view of the receptacle of FIG. 16.
Figure 22:
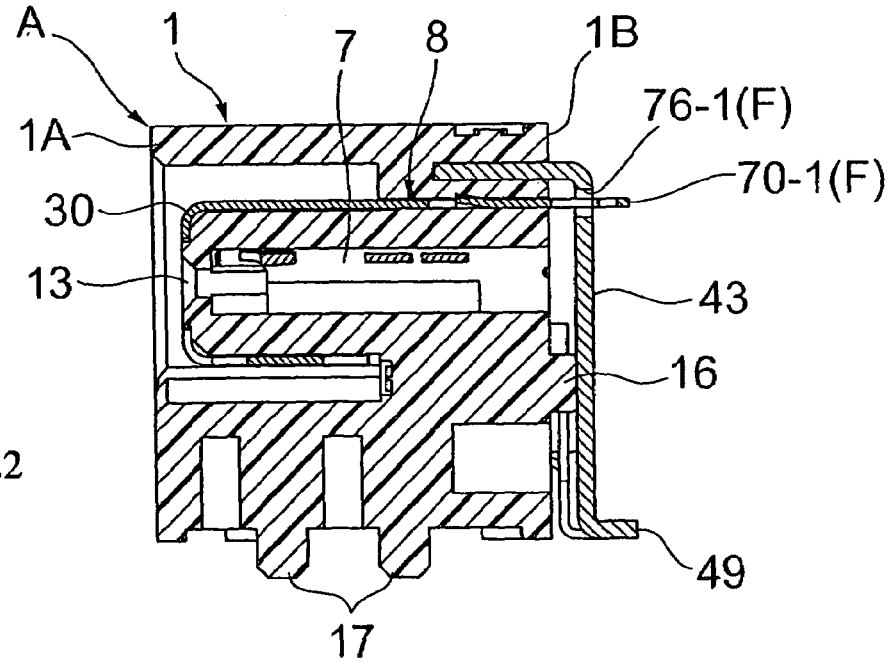
FIG. 22 is a cross-sectional view of FIG. 19 taken along line G—G.

More specifically, as shown in FIGS. 16–17, the conductive contact section F has a contact shoe 70, which is provided at the center of the edge 31e of the edge shielding section 31A of the first outer conductor 3, which faces the second outer conductor 4, so as to protrude toward the second outer conductor, and a contact shoe joining hole 76 provided at the backside shielding section 43. The conductive contact means F is formed by inserting and joining the contact shoe to the contact shoe joining hole 76, and contacting the contact shoe 70 to the inner surface 76*a* of the contact shoe joining hole 76.

Figure 23:
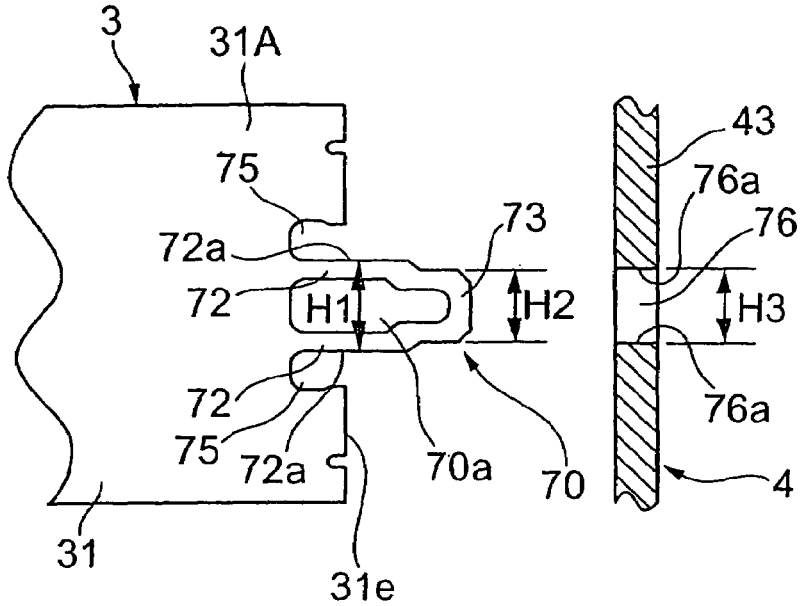
FIG. 23 is an explanatory figure of the contact shoe and shoe joining hole of the conductive contact means of the receptacle of FIG. 16.
Figure 24:
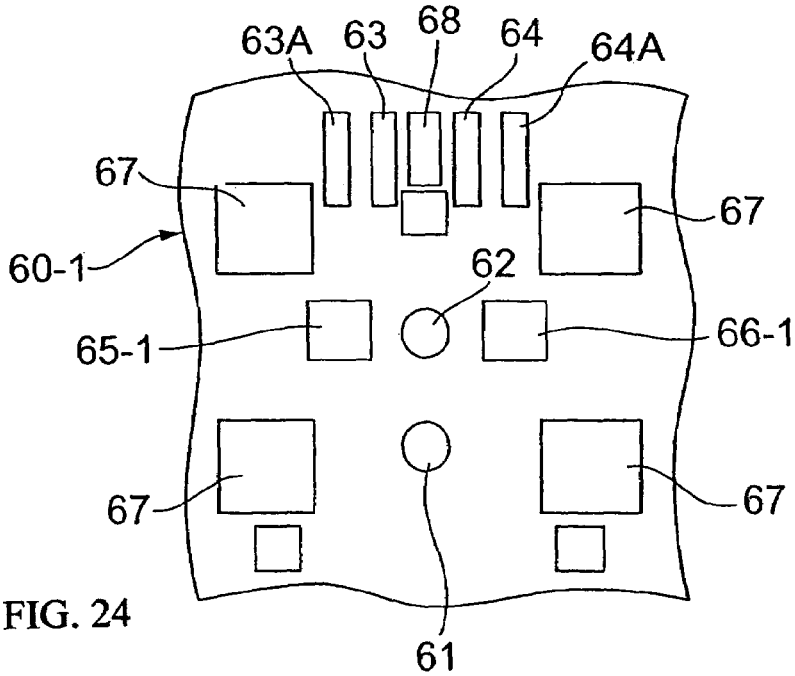
FIG. 24 is an explanatory figure of the printed circuit board to mount the receptacle (second embodiment).
Figure 25:
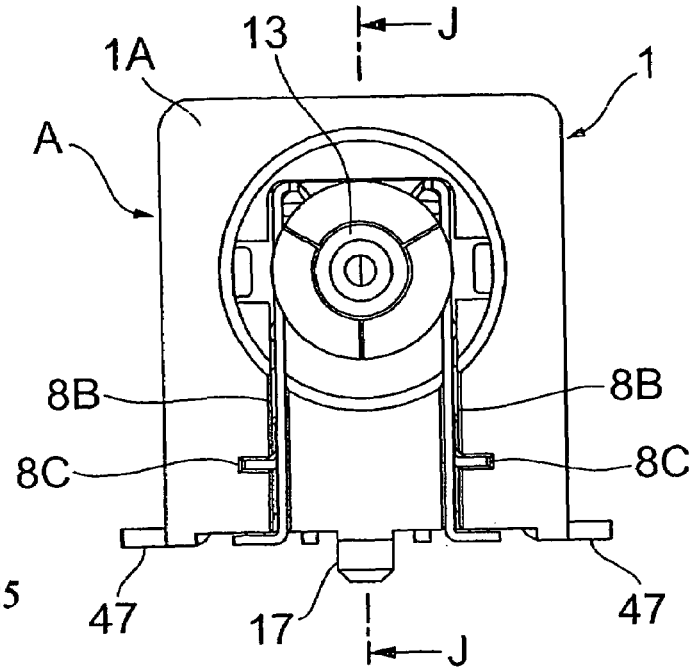
FIG. 25 is a front view of a receptacle, which is an example of modification of the one (second embodiment).

As shown in FIG. 23, the contact shoe 70 is integrally formed with the first outer conductor when the first outer conductor 3 is formed by press-cutting. The contact shoe 70 has a pair of conductive contact sections 72 at the sides of punched hole 70*a* on the base portion, and has a insertion section 73 at its end.

The dimension H1 between the outer edges 72*a* of the conductive contact sections 72 is set larger than the width dimension H2 of the insertion section 73. Notches 75 are formed on the sides of the contact shoe 70 at the edge 31*e* of the edge shielding section 31A. With those notches 75, the conductive contact sections 72 can be longer and flexed more.

The contact shoe joining hole 76 has a slit-shape, and is formed on the center upper portion of the backside shielding section 43. As shown in FIG. 23, the width dimension H3 of the contact shoe joining hole 76 is smaller than the dimension H1 between the outer edges 72*a* of the conductive contact sections 72, but larger than the width dimension H2 of the insertion section 73.

Similarly to the first embodiment of the invention described above, the pair of strip-shaped contact sections 48 provided at the backside shielding section 43 is inserted to the pair of insertion grooves 10 of the second shielding member attaching section 9, and the contact point section 48A of the contact section 48 contacts with the side shielding section 31B of the first outer conductor 3. At this time, the contact shoe 70 is inserted to the contact shoe joining hole 76 from the insertion section 73, the edges 72*a* of the conductive contact sections 72 contact with the edges of the sides of the contact shoe joining hole 76. If the contact shoe is further inserted, the conductive contact section 72 receive compression force in the width direction of the contact section 48, and flexes in the width direction. With the compression reaction force, the outer edges 72*a* of the conductive contact sections 72 elastically contacts with the sides 76 of the contact shoe joining hole 76.

As described above, the first and the second outer conductors 3 and 4 are attached to the insulating housing 1, and the contact section 48 provided on the backside shielding section 43 of the second outer conductor 4 is contacted with the side shielding section 31B of the first outer conductor 3. In addition, the contact shoe 70 provided on the edge shielding section 31A of the first outer conductor 3 is inserted and joined to the contact shoe joining hole 76 provided on the backside shielding section 43 of the second outer conductor 4. The outer edges 72*a* of the conductive contact sections 72 are elastically contacted with the sides of the contact shoe joining hole 76. By doing the above, the first and the second outer conductors are connected to each other. By surrounding the front of and around the switching terminal 20 and the connecting terminal 21, which are inner conductor 2, with the first outer conductor 3, and surrounding the backside of those terminals with the backside shielding section 43 of the second outer conductor 4, those terminals 20 and 31 are completely shielded.

Accordingly, for the path of ground current, in addition to the one from the side shield section 31B of the first outer conductor 3 to the second outer conductor 4 via the contact section 48, the one from the edge shielding section 31A of the first outer conductor 3 to the second outer conductor 4 via the conductive contact means (contact shoe 70 and sides 76*a* of the contact shoe joining hole 76). Therefore, the function of the outer conductor, which is comprised of first and the second outer conductors 3, can be improved, and the high-frequency performance can be improved.

As shown in FIGS. 16 and 17, in the first outer conductor 3, the lead sections 33-1 formed at the edges 31*b* of the both side shielding sections 31B are bent perpendicularly so as to enable mounting on a flat surface. For this reason, the printed circuit board 60-1 illustrated in FIG. 24 has conductive patterns (conductive sections) 65-1 and 66-1 in place of thru holes (conductive sections) 65 and 66 of the printed circuit board 60-1 in the first embodiment of the invention.

Accordingly, the receptacle A is mounted on the printed circuited board as follows. The latching protrusion 17 provided on the circuit board side section 1C is inserted and latched in the latching holes 61 and 62 of the printed circuit board, and the respective lead sections 20B and 21B of the switching terminal 20 and the connecting terminal 21 are soldered to the conductive patterns (conductive sections) 63 and 64. The lead sections 33-1 of the first outer conductor 3 are soldered to the conductive patterns (conductive sections) 65-1 and 66-1, and the lead sections 34 of the first outer conductor are soldered to the conductive patterns (conductive sections) 63A and 64A and connected to ground. The lead section 47 of the second outer conductor 4 is soldered to the conductive pattern (conductive section) 67, and connected to ground. In addition, the lead section 49 of the backside shielding section 43 of the second outer conductor 4 is soldered to the conductive pattern (conductive section) 68, and connected to ground. Joining between the receptacle A and the plug B, which are constituted as described above, is similar to that of the first embodiment, which is described above, and the explanation is omitted.

According to the second embodiment, the first and the second outer conductors 3 and 4 are attached to the insulating housing 1, and the contact section 48 provided on the backside shielding section 43 of the second outer conductor 4 is contacted with the side shielding section 31B of the first outer conductor 3. The contact shoe 70 provided on the edge shielding section 31A of the first outer conductor 3 is inserted and joined in the contact shoe joining hole 76 provided on the backside shielding section 43 of the second outer conductor 4, and the outer edges 72*a* of the conductive contact section 72 are elastically contacted with the both sides 76*a* of the contact shoe joining hole 76, so that the first and the second outer conductors are electrically connected to each other. Accordingly, for the path of ground current, in addition to the path from the side shielding section 31B of the first outer conductor 3 to the second outer conductor 4 via the contact sections 48, the path from the edge shielding section 31A of the first outer conductor 3 to the second outer conductor 4 via the contact shoe 70 is added. Accordingly, the function as a outer conductor comprised of the first and the second outer conductors 3 and 4 can be improved, and therefore, the high-frequency performance can be improved. Furthermore, since the contact shoe 70 elastically contacts with the sides 76*a* of the contact shoe joining hole 76, the first and the second outer conductors 3 and 4 can be securely connected to each other.

According to the second embodiment, in the first outer conductor 3, the lead sections 33-1 formed on the edges 31*b* of the side shielding section 31B are perpendicularly bent so as to be mounted on a flat surface. When the receptacle A is mounted on the printed circuit board 60-1, the lead sections 33-1 of the first outer conductor 3 are soldered on the conductive patterns (conductive section) 65-1 and 66-1. Therefore, the cylindrical section 30 can be securely connected to ground by the lead sections 33-1 provided near the cylindrical section 30 and near the contacting position with the counter outer conductor, and therefore, satisfactory high-frequency performance can be obtained.

In the second embodiment of the invention, the contact shoe 70 is one, and provided at the center portion of the edge 31*e* of the edge shielding section 31A of the first outer conductor 3, which faces toward the second outer conductor. The first and the second outer conductors 3 and 4 are connected to each other by inserting and joining the contact shoe 70 in the contact shoe joining hole 76*a* provided on the backside shielding section 43 of the second outer conductor 4, and elastically contacting the outer edges 72*a* of the conductive contact section 72 with the both sides 76*a* of the contact shoe joining hole 76. However, the number of contact shoes 70 can be increased by providing them on the edge of the both side shielding sections 31B of the first outer conductor 3 in addition to the one on the edge 31*e* of the edge shielding section 31A of the first outer conductor 3. Correspondingly, the number of the contact shoe joining holes 76 can be also increased by providing a plurality of the contact shoe joining hole 76 on the backside shielding section 43 of the second outer conductor 4. Then, the first and the second outer conductors can be connected to each other by inserting the contact shoes 70 in the contact joining holes 76, and elastically contacting the outer edge 72*a* of the conductive contact section 72 with the both sides 76*a* of the contact shoe joining hole 76.

As shown in FIG. 23, in the above-described second embodiment, the contact shoe 70 has a pair of the conductive contact sections 72 at its base portion, and has an insertion section 73 at its end. As an example of modification of the contact shoe, a pair of joining catches (not illustrated) can be formed between the conductive contact sections 72 and the insertion section 73. In this case, it is preferred that the dimension between the joining catch and the edge 31*e* of edge shielding section 31A, which faces the second outer conductor, is substantially same as the thickness of the backside shielding section 43.

Therefore, while the contact shoe 70 is inserted in the contact shoe joining hole 76, the conductive contact sections 72 are elastically contacted with the both inner surfaces of 76*a* of the contact shoe joining hole 76, and the pair of the joining catches are caught by the outer surface of the backside shielding section 43 and prevented from coming off. In addition, with catches caught by the outer surface of the backside shielding section 43, the inner surface of the backside section 43 contacts with the edge 31*e* of the edge shielding section 31A, and therefore, the first and the second outer conductors can be securely connected to each other.

An example of modification of the second embodiment of the coaxial connector is shown in FIGS. 25–29. Here, same elements as in the above-described second embodiment are denoted by the same reference numerals and the explanation will be omitted.

Figure 28:
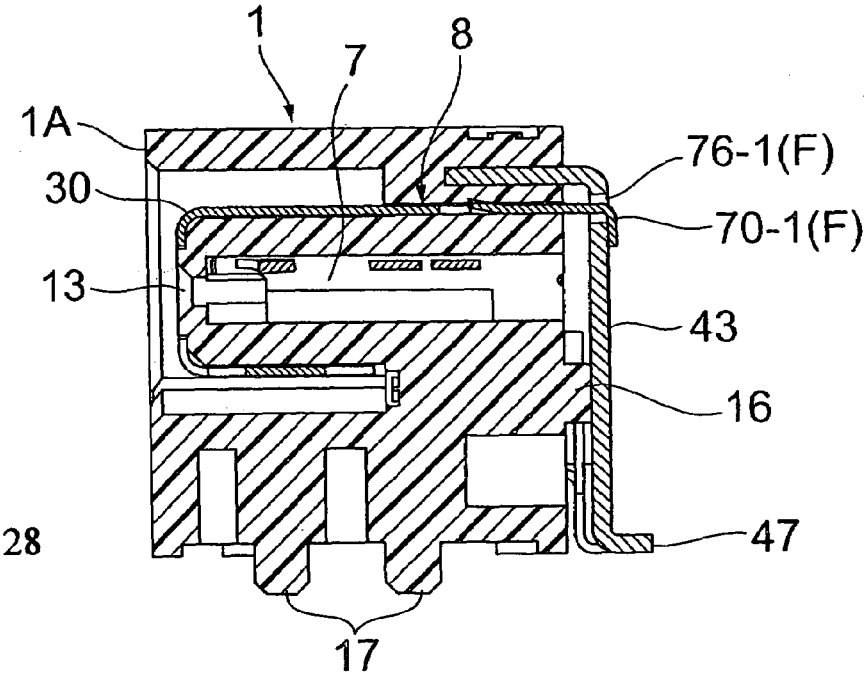
FIG. 28 is a cross-sectional view of the receptacle of FIG. 25 taken along line J—J.
Figure 29:
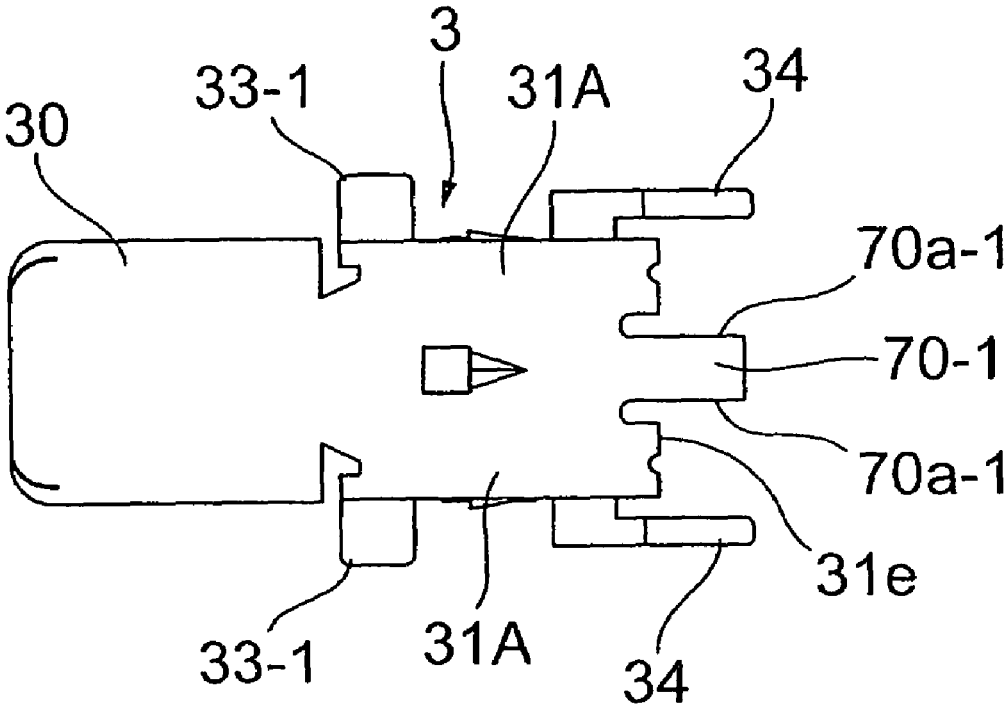
FIG. 29 is a top view of the first outer conductor.

In this example of modification, the conductive contact means F is comprised of a strip-shaped contact shoe 70-1, which protrudes from the center portion of the edge 31*e* of the edge shielding section 31A as shown in FIG. 28, and a slit-shaped contact shoe joining hole 76-1 formed at the backside shielding section 43 of the second outer conductor 4.

Figure 26:
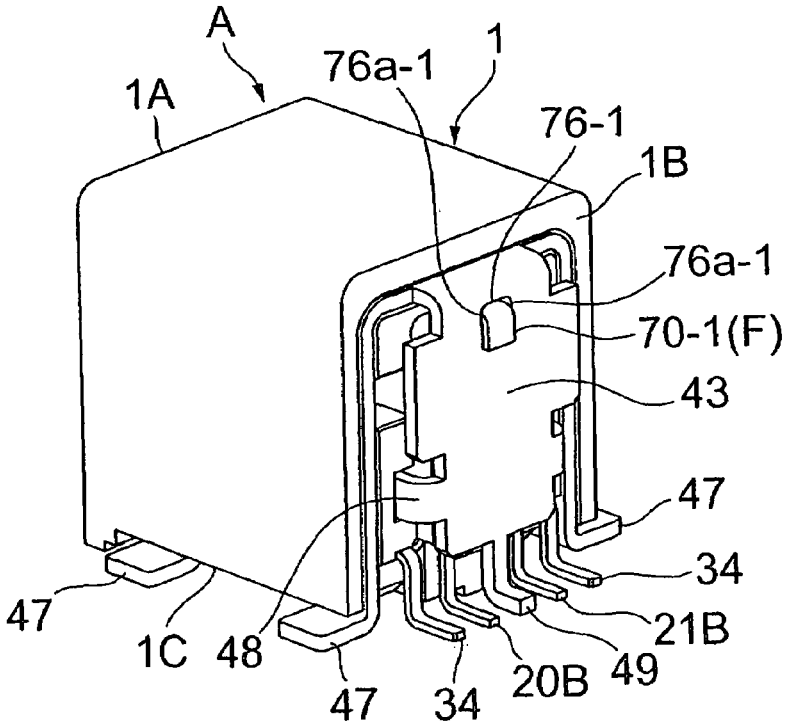
FIG. 26 is a perspective backside view of the receptacle of FIG. 25.
Figure 27:
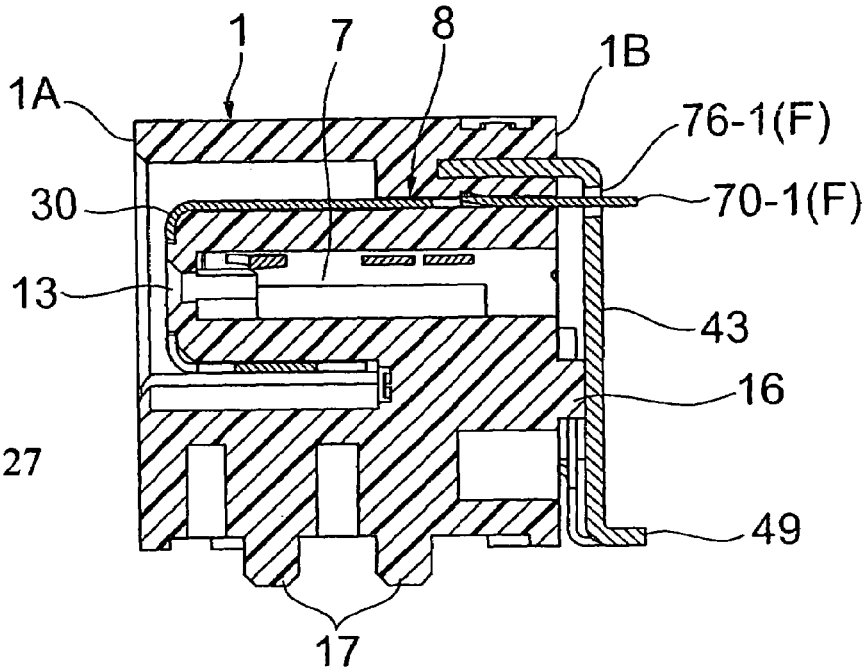
FIG. 27 is an explanatory cross-sectional view of the receptacle of FIG. 25 before bending the contact shoe, which is taken along line J—J in FIG. 25.

Similarly to the above-described first embodiment of the invention, when the pair of strip-like contact sections 48 are inserted in the pair of insertion groove 10, and the contact point section 48A is contacted with the side shielding section 31B of the first outer conductor 3, the contact shoe 70-1 is inserted in the contact shoe joining hole 761 and contacted with the sides 76*a*-1 of the contact shoe joining hole 76-1, as shown in FIGS. 26–27. Then, as shown in FIG. 28, by bending the end portion of the contact shoe 70-1, which protrudes backward from the contact shoe joining hole 76-1, the first outer conductor 3 is latched onto the second outer conductor 4. At this time, the inner surface of the backside shielding section 43 contacts with the edges 31*e* of the edge shielding section 31A and the side shielding section 31B.

As described above, the first and the second outer conductors 3 and 4 are attached to the insulating housing 1, and the contact sections 48 provided on the backside shielding section are contacted with the side shielding section 31B. In addition, the contact shoe 70-1 provided on the edge shielding section 31A is inserted in the contact shoe joining hole 76-1, and the both edges 70*a*-1 of the contact sections 70-1 are contacted with the both sides 76*a*-1 of the contact shoe joining hole 76-1. Furthermore, the end portion of the contact shoe 70-1, which protrudes backward from the contact shoe joining hole 76-1, is bent, and contacted with the outer surface of the backside shielding section 43 so as to be latched. Then, the inner surface of the backside shielding section 43 is contacted with the edges 31*e* of the edge shielding section 31A and the side shielding section 31B, and the first and the second outer conductors 3 and 4 are connected to each other. The first outer conductor 3 surrounds the front of and around the switching terminal 20 and the connecting terminal, which constitute the inner conductor 2, so that the switching terminal 20 and the connecting terminal 21 are completely shielded.

Therefore, the ground current flows not only in the second outer conductor 4 from the side shielding section 31B of the first outer conductor 3 via the contact section 48, but also flows in the second outer conductor 4 from the edge shielding section of the first outer conductor 3 via the contact shoe 70-1, so that the function as the outer conductor, which is comprised of the first and the second outer conductors 3 and 4, is improved and therefore, the high-frequency performance is improved.

Figure 30:
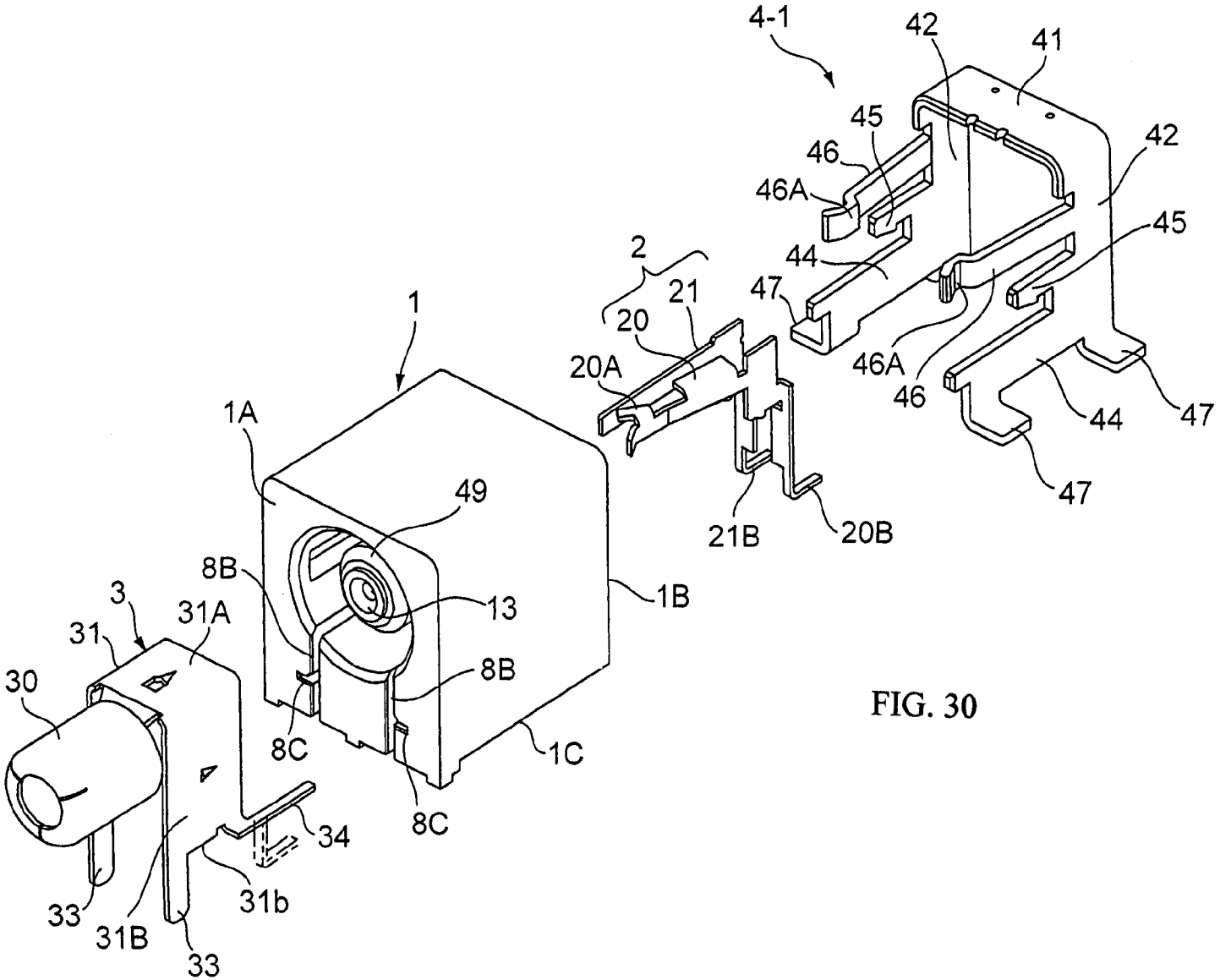
FIG. 30 is an exploded perspective front view of the receptacle (third embodiment), which is the coaxial connector of the invention.
Figure 31:
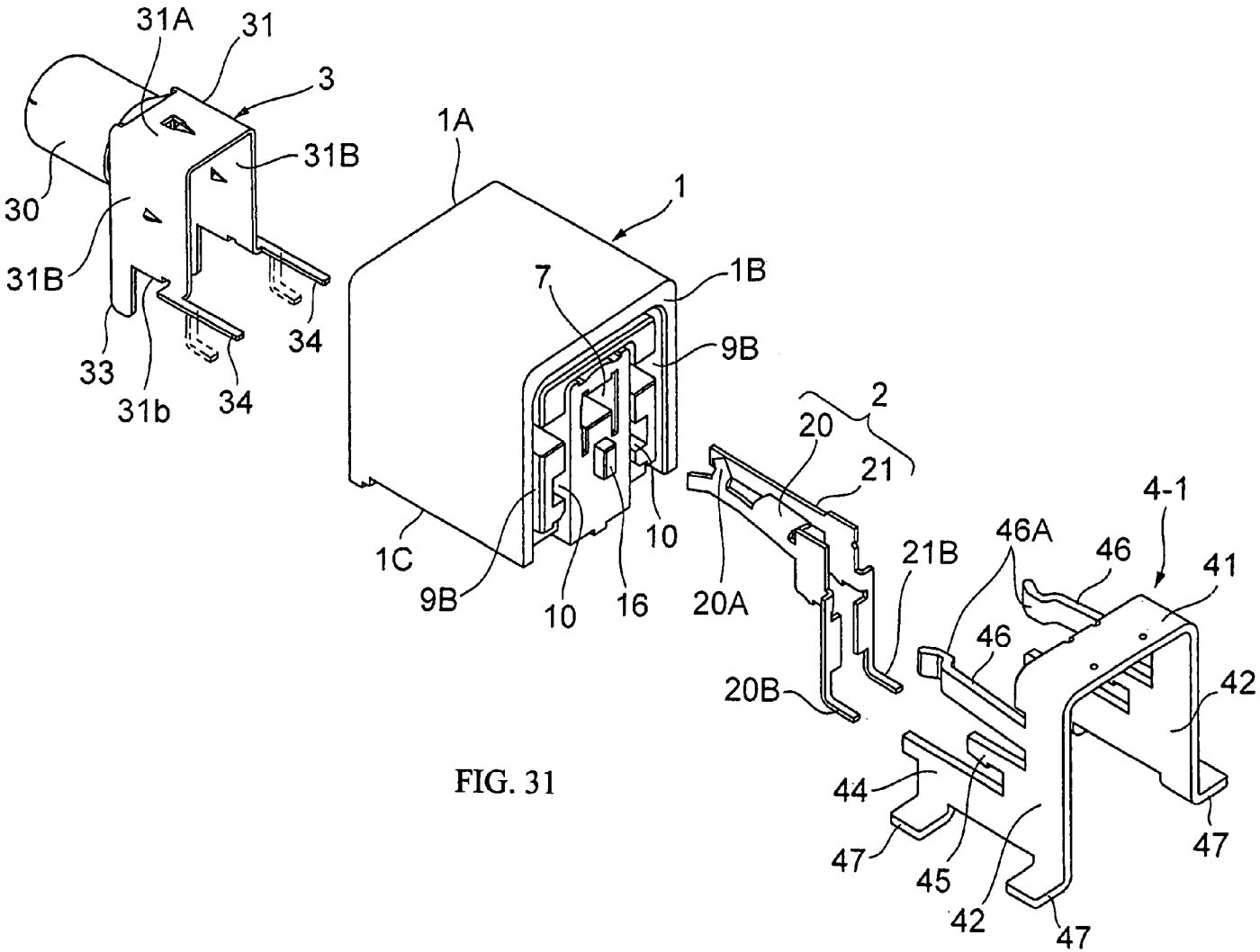
FIG. 31 is an exploded perspective backside view of the receptacle of FIG. 30.
Figure 32:
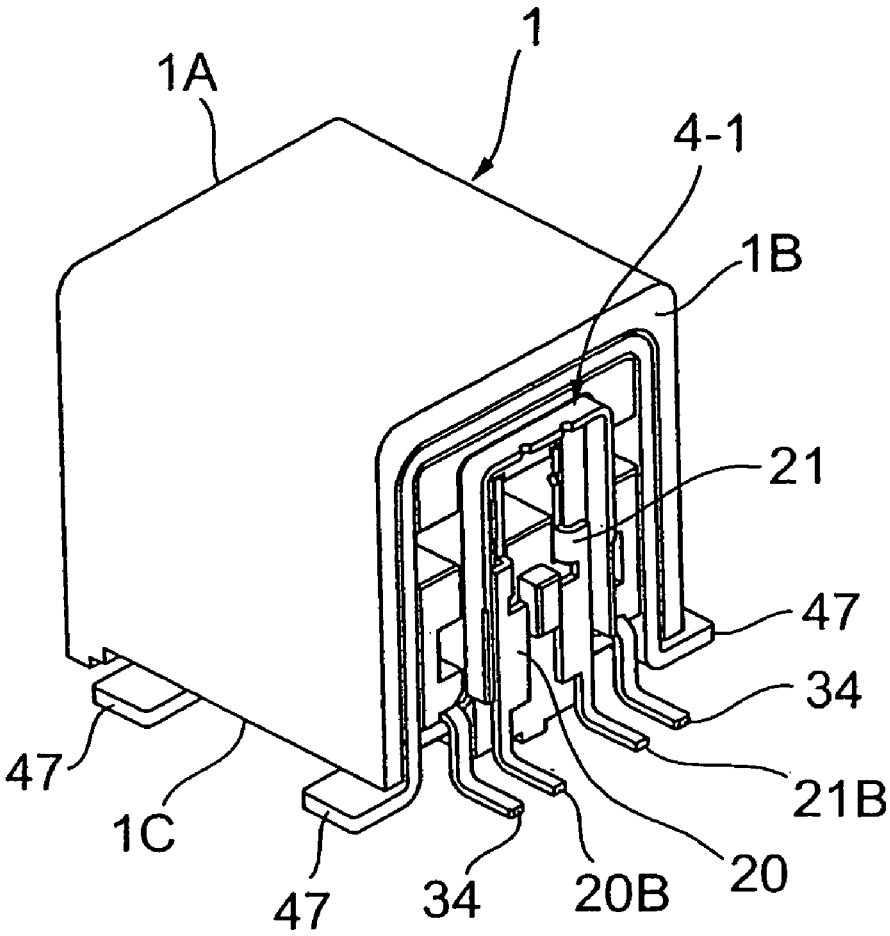
FIG. 32 is a perspective backside view of the receptacle of FIG. 30.
Figure 33:
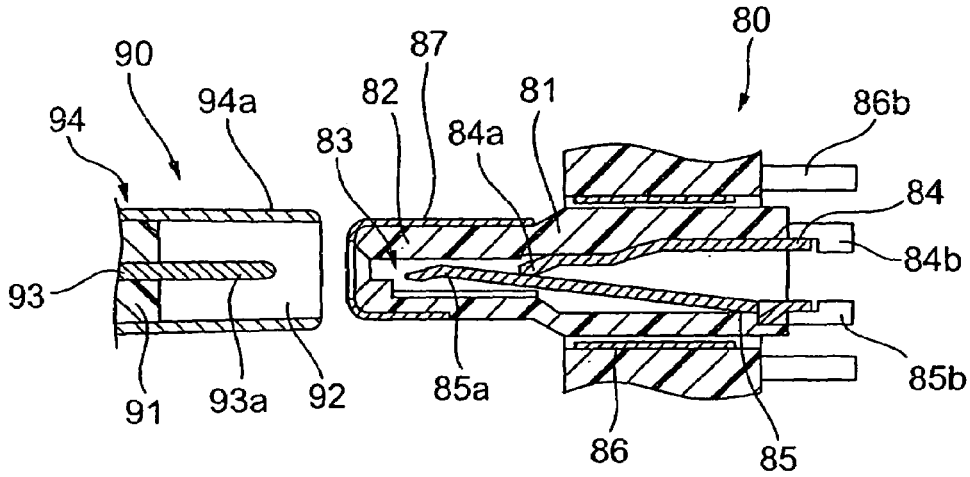
FIG. 33 PRIOR ART
FIG. 33 is a longitudinal cross-sectional view of the coaxial connector.
Figure 34:
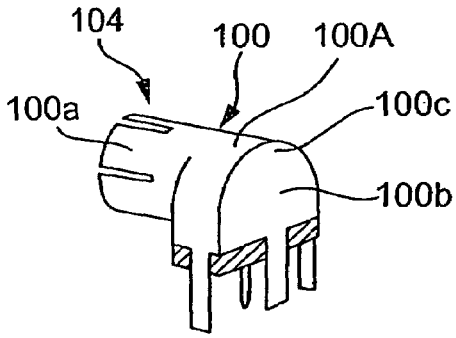
FIG. 34 PRIOR ART
FIG. 34 is a perspective backside view of another conventional coaxial connector.
Figure 35:
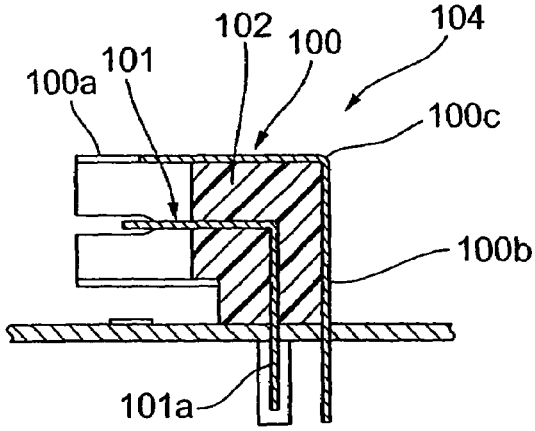
FIG. 35 PRIOR ART
FIG. 35 is a longitudinal cross-sectional view of the receptacle of FIG. 34.

Third Embodiment:

The third embodiment of the coaxial connector of the invention is shown in FIGS. 30–32.

The difference of the third embodiment from the above-described first embodiment is that the second outer conductor 4-1 of the third embodiment does not have the backside shielding section 43, and the contact section 48 and the lead section 49 provided on the backside shielding section 43.

Accordingly, the contact between the pair of contact sections 48 of the backside shielding section 43 and the side shielding section 31B of the first outer conductor 3 is not made. In addition, the contact of edges of the edge shielding section 31A of the first outer conductor 3 and the side shielding section 31B with the inner surface of the backside shielding section is not made. Also, the contact between the first outer conductor 3 and the second outer conductor 4 is not made.

The constitution and operation of the third embodiment are same as those of the first embodiment except the contact between the first and the second outer conductors 3 and 4. Therefore, same reference numerals are used, and the explanation is omitted.

According to the third embodiment, the outer conductor is comprised of the first outer conductor 3 and the second outer conductor 4. The first outer conductor 3 has a cylindrical section 30, and an inverted U-shaped section 31, which extends from the cylindrical section 30. Lead sections 33, which are circuit board connecting sections, are provided at the edges 31*b* of the inverted U-shaped section 31 so as to be close to the cylindrical section 30. Lead sections 47, which are circuit board connecting sections, are provided on the second outer conductor 4. Each of lead sections 33 and 47 is soldered to the conductive section of the printed circuit board, and the first and the second outer conductors 3 and 4 are connected to ground. Therefore, even when backside shielding is not applied to the switching terminal 20 and the connecting terminal 21, the connection to ground can be securely made by the lead sections, which are provided near the cylindrical section 30, and satisfactory high-frequency performance can be obtained.

In the coaxial connector of this invention, the joining with the counter connector can be made with the locking means of the outer conductor, and the joining (locking) with the counter connector is securely made. Even if the counter connector (e.g. plug) receives external force so often, the counter connector (e.g. plug) will not come off. Since the outer conductor is comprised of the first outer conductor and the second outer, and the first and the second outer conductors are connected to each other via the contact means, complete shielding of the inner conductor is easy, and satisfactory high-frequency performance can be obtained. In addition, the coaxial connector of the invention can be loaded to information terminal devices such as cellular phones, and can be useful as a coaxial connector having a switch, which is used in input/output unit of such device.

The invention claimed is:

1. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, a locking section for joining with the counter connector, and a lead section provided at a lower edge of said backside shielding section, said first and said second outer conductors have a contact means to connect to each other, said first and said second outer conductors are connected to each other via said contact means, and said contact means is composed by providing a contact section on said backside shielding section and contacting said contact section with said first outer conductor.

2. The coaxial connector according to claim 1, wherein said insulating housing has a first outer conductor attaching section and a second outer conductor attaching section, and said first outer conductor and said second outer conductor are attached to said housing by attaching said first and said second outer conductors to said first and said second outer conductor attaching sections respectively.

3. The coaxial connector according to claim 1, wherein said contact means is composed by providing a pair of said contact sections on said backside shielding section, contacting said contact sections with both sides of said first outer conductor, and contacting said first outer conductor with said backside shielding section via a conductive contact means.

4. The coaxial connector according to claim 3, wherein said conductive contact means is composed by providing a contact shoe at an edge of said first outer conductor, which faces said second outer conductor, providing a contact shoe joining hole on said backside shielding section, inserting and joining said contact shoe in said contact shoe joining hole, and contacting said contact shoe with an inner surface of said contact shoe joining hole.

5. The coaxial connector according to claim 4, wherein said contact shoe joining hole has a slit-like shape, said contact shoe has at a base portion a pair of conductive contact sections, which are elastically deformable, said conductive contact section elastically contacts with the inner surface of said contact shoe joining hole while said contact shoe is inserted in said contact shoe joining hole.

6. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, and a locking section for joining with the counter connector, said first and said second outer conductors have a contact means to connect to each other, and said first and said second outer conductors are connected to each other via said contact means, said contact means is composed by providing a pair of said contact sections on said backside shielding section, contacting said contact sections with both sides of said first outer conductor, and contacting said first outer conductor with said backside shielding section via a conductive contact means, said conductive contact means is composed by providing a contact shoe at an edge of said first outer conductor, which faces said second outer conductor, providing a contact shoe joining hole on said backside shielding section, inserting and joining said contact shoe in said contact shoe joining hole, and contacting said contact shoe with an inner surface of said contact shoe joining hole, said contact shoe joining hole has a slit-like shape, said contact shoe has a strip shape, said contact shoe is inserted in said contact shoe joining hole and both side of the contact shoe contact with the inner surface of said contact shoe joining hole, the end portion of said contact shoe, which protrude from said contact shoe joining hole, is bent so as to contact with the outer surface of said backside shielding section, and the edge of said first outer conductor, which faces said second outer conductor, contacts with the inner surface of said backside shielding section.

7. The coaxial connector according to claim 1, wherein said inner conductor is comprised of a first center terminal, and a second center terminal, which works as a switching terminal that moves away from said first center terminal by contacting with a contact section of said counter inner conductor, said backside shielding section has a backside circuit board connecting section for ground 5 connection to a printed circuit board, and said backside circuit board connecting section is arranged between the circuit board connecting sections of said first and said second center terminals.

8. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, and a locking section for joining with the counter connector, said first and said second outer conductors have a contact means to connect to each other, and said first and said second outer conductors are connected to each other via said contact means, said conductive contact means is composed by providing a contact shoe at the edge of said first outer conductor, which faces said second outer conductor, providing a contact shoe joining hole on said backside shielding section, inserting and joining said contact shoe in said contact shoe joining hole, and contacting said contact shoe with the inner surface of said contact shoe joining hole, said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals, said first outer conductor has a cylindrical section and an inverted a-shaped section, which extends from said cylindrical section, the edge of said inverted U-shaped section has one circuit board connecting section so as to be close to said cylindrical section and has the other circuit board connecting section so as to protrude opposite said cylindrical section, and said first outer conductor is connected to ground by connecting said circuit board connecting sections to a conductive section of the printed circuit board respectively.

9. The coaxial connector according to claim 8, wherein said circuit board connecting sections of said first and said second center terminals protrude from the backside of said insulating housing, the edge of said first outer conductor protrudes from said backside so as to contact with said backside shielding section, and said circuit board connecting sections are covered by said edge and said backside shielding section.

10. The coaxial connector according to claim 9, wherein the second outer conductor is positioned by providing a protrusion on said backside, and contacting said protrusion with said backside shielding section at the time of attaching said second outer conductor of said insulating housing, said circuit board connecting section of said first center terminal and said circuit board connecting section of said second center terminal are respectively arranged at one side of said protrusion and the other side of said protrusion.

11. A coaxial connector, comprising:

an insulating housing;

an inner conductor for connecting to the counter inner conductor of the counter connector; and an outer conductor for connecting to the counter outer conductor of the counter connector, wherein said inner conductor and said outer conductor are attached to said insulating housing, said outer conductor is comprised of a first outer conductor and a second outer conductor, said first outer conductor is comprised of a cylindrical section and an inverted U-shaped section that is extended from said cylindrical section and has an edge shielding section and side shielding sections provided at opposite sides of said edge shielding section, a circuit board connecting section extending downwardly from each of said side shielding sections near said cylindrical section, said second outer conductor has a circuit board connecting section, and those circuit board connecting sections are connected to conductive sections of a printed circuit board so as to connect said first and said second outer conductors to ground.

12. The coaxial connector according to claim 2, wherein said contact means is composed by providing a contact section on said backside shielding section and contacting said contact section with said first outer conductor.

13. The coaxial connector according to claim 2, wherein said contact means is composed by providing a pair of said contact sections on said backside shielding section, contacting said contact sections with both sides of said first outer conductor, and contacting said first outer conductor with said backside shielding section via a conductive contact means.

14. The coaxial connector according to claim 2, wherein said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

15. The coaxial connector according to claim 1, wherein said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

16. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, and a locking section for joining with the counter connector, said first and said second outer conductors have a contact means to connect to each other, and said first and said second outer conductors are connected to each other via said contact means, said contact means is composed by providing a pair of said contact sections on said backside shielding section, contacting said contact sections with both sides of said first outer conductor, and contacting said first outer conductor with said backside shielding section via a conductive contact means, said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

17. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, and a locking section for joining with the counter connector, said first and said second outer conductors have a contact means to connect to each other, and said first and said second outer conductors are connected to each other via said contact means, said contact means is composed by providing a pair of said contact sections on said backside shielding section, contacting said contact sections with both sides of said first outer conductor, and contacting said first outer conductor with said backside shielding section via a conductive contact means, said conductive contact means is composed by providing a contact shoe at an edge of said first outer conductor, which faces said second outer conductor, providing a contact shoe joining hole on said backside shielding section, inserting and joining said contact shoe in said contact shoe joining hole, and contacting said contact shoe with an inner surface of said contact shoe joining hole, said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

18. A coaxial connector, comprising:

an insulating housing;

an inner conductor to be connected to a counter inner connector of a counter connector; and an outer conductor to be connected to a counter outer connector of the counter connector, which is comprised of a first outer conductor and a second outer conductor, wherein said second outer conductor has a backside shielding section to cover a backside, and a locking section for joining with the counter connector, said first and said second outer conductors have a contact means to connect to each other, and said first and said second outer conductors are connected to each other via said contact means, said contact means is composed by providing a pair of said contact sections on said backside shielding section, contacting said contact sections with both sides of said first outer conductor, and contacting said first outer conductor with said backside shielding section via a conductive contact means, said conductive contact means is composed by providing a contact shoe at an edge of said first outer conductor, which faces said second outer conductor, providing a contact shoe joining hole on said backside shielding section, inserting and joining said contact shoe in said contact shoe joining hole, and contacting said contact shoe with an inner surface of said contact shoe joining hole, said contact shoe joining hole has a slit-like shape, said contact shoe has at a base portion a pair of conductive contact sections, which are elastically deformable, said conductive contact section elastically contacts with the inner surface of said contact shoe joining hole while said contact shoe is inserted in said contact shoe joining hole, wherein said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

19. The coaxial connector according to claim 6, wherein said inner conductor is comprised of a first center terminal, and a second center terminal, which works as a switching terminal that moves away from said first center terminal by contacting with a contact section of said counter inner conductor, said backside shielding section has a backside circuit board connecting section for ground connection to a printed circuit board, and said backside circuit board connecting section is arranged between the circuit board connecting sections of said first and said second center terminals.

* * * * *